US007433609B2

(12) United States Patent
Furuichi et al.

(10) Patent No.: US 7,433,609 B2
(45) Date of Patent: Oct. 7, 2008

(54) IMAGE FORMING APPARATUS WITH A PLURALITY OF IMAGE FORMING UNITS

(75) Inventors: Yoshinori Furuichi, Kanagawa (JP); Miki Kouchi, Kanagawa (JP); Noritada Ohi, Saitama (JP); Hidemasa Morimoto, Kanagawa (JP); Rie Nakamura, Tokyo (JP); Akihiro Kakoi, Kanagawa (JP); Masato Takahashi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 257 days.

(21) Appl. No.: 11/313,639

(22) Filed: Dec. 22, 2005

(65) Prior Publication Data

US 2006/0159469 A1 Jul. 20, 2006

(30) Foreign Application Priority Data

Dec. 24, 2004 (JP) ..... 2004-374721

(51) Int. Cl.
*G03G 15/00* (2006.01)

(52) U.S. Cl. ..... 399/13

(58) Field of Classification Search ..... 399/13, 399/367, 369, 393

See application file for complete search history.

(56) References Cited

U.S. PATENT DOCUMENTS 5,162,845 A * 11/1992 Ariyama et al. ..... 399/13

FOREIGN PATENT DOCUMENTS

| | | |
|---|---|---|
| JP | 2-21190 | 5/1990 |
| JP | 5-191589 | 7/1993 |
| JP | 5-304575 | 11/1993 |
| JP | 6-259359 | 9/1994 |
| JP | 7-175916 | 7/1995 |
| JP | 7-273957 | 10/1995 |
| JP | 7-321974 | 12/1995 |
| JP | 10-74163 | 3/1998 |
| JP | 10-126537 | 5/1998 |
| JP | 2000-47536 | 2/2000 |
| JP | 2003-91214 | 3/2003 |
| JP | 3476554 | 9/2003 |
| JP | 3501437 | 12/2003 |
| JP | 3524152 | 2/2004 |
| JP | 3537612 | 3/2004 |

* cited by examiner

*Primary Examiner*—Ryan Gleitz
(74) *Attorney, Agent, or Firm*—Oblon, Spivak, McClelland, Maier & Neustadt, P.C.

(57) ABSTRACT

An image forming apparatus includes two or more detachable components that are identical to each other and configured to perform at least part of a sequence of processes associated with forming of an image, a connection detection unit configured to detect attaching of the components, and a first control unit configured to control the sequence of processes, wherein a software-based controller for controlling one of the components is generated in response to detection by the connection detection unit of the attaching of the one of the components.

21 Claims, 23 Drawing Sheets

* N_MAX: NUMBER OF IMAGING UNITS PROVIDED IN IMAGE FORMING APPARATUS

FIG.17

| UNIT | CORRESPONDING POWER SUPPLY CONTROL UNIT |
|---|---|
| IMAGING UNIT (1) | POWER SUPPLY CONTROL UNIT (1) |
| IMAGING UNIT (2) | POWER SUPPLY CONTROL UNIT (2) |
| IMAGING UNIT (3) | POWER SUPPLY CONTROL UNIT (3) |
| ⋮ | ⋮ |
| SCANNER UNIT (1) | POWER SUPPLY CONTROL UNIT (7) |
| SCANNER UNIT (2) | POWER SUPPLY CONTROL UNIT (8) |
| SCANNER UNIT (3) | POWER SUPPLY CONTROL UNIT (9) |
| ⋮ | ⋮ |

* N_MAX: NUMBER OF IMAGING UNITS PROVIDED IN IMAGE FORMING APPARATUS

FIG.21A

| | CORRESPONDING UNIT 1 | CORRESPONDING UNIT 2 |
|---|---|---|
| POWER SUPPLY CONTROL UNIT (1) | IMAGING UNIT (1) | – |
| POWER SUPPLY CONTROL UNIT (2) | IMAGING UNIT (2) | – |
| POWER SUPPLY CONTROL UNIT (3) | IMAGING UNIT (3) | SCANNER UNIT (3) |
| ⋮ | ⋮ | ⋮ |
| POWER SUPPLY CONTROL UNIT (7) | SCANNER UNIT (1) | – |
| POWER SUPPLY CONTROL UNIT (8) | SCANNER UNIT (2) | – |
| POWER SUPPLY CONTROL UNIT (9) | SCANNER UNIT (4) | – |
| ⋮ | ⋮ | ⋮ |

FIG.21B

| STATUS OF CORRESPONDING UNIT | STORED VALUE |
|---|---|
| IN USE | 1 |
| NOT IN USE | 0 |

* N_MAX: NUMBER OF IMAGING UNITS PROVIDED IN IMAGE FORMING APPARATUS

FIG.25

| | PRINT AMOUNT SETTING 1 | PRINT AMOUNT SETTING 2 | PRINT AMOUNT SETTING 3 | MAXIMUM PRINT AMOUNT SETTING |
|---|---|---|---|---|
| PRINT AMOUNT CONDITION | FEWER THAN 50 COPIES | FEWER THAN 100 COPIES | FEWER THAN 200 COPIES | MORE THAN OR EQUAL TO 200 |
| NUMBER OF SIMULTANEOUSLY POWERED-ON UNITS | 3 | 6 | 9 | 9 |

IMAGE FORMING APPARATUS WITH A PLURALITY OF IMAGE FORMING UNITS

BACKGROUND OF THE INVENTION

1. Field of the Invention

The present invention relates to an image forming apparatus that is provided with a plurality of specific components.

2. Description of the Related Art

Image forming apparatuses such as copier machines distributed in the marketplace are each provided with components such as a scanner unit, an imaging unit, etc., which achieve the function of an image forming apparatus. There is only one combination as a sequence of processes that are associated with a copying function. Accordingly, components for performing such processes are fixed in advance. Since the time required to perform a given process depends on the amount of documents to be scanned, the conditions specified for the scan, the condition of usage such as use by other users, etc., the efficiency of work such as the printing of outputs may decrease. Further, the copying operation needs to be suspended if an anomaly is found in part of the process. This results in the work being suspended until the problem is fixed, causing the efficiency of work to drop.

In order to cope with these, the components that constitute an image forming apparatus may be provided in several sets, with these sets operating in parallel. Since having several sets means that the process required for copying becomes complicated, such complication results in the efficiency of work dropping, causing an increase in cost. Further, as the number of components used in an image forming apparatus increases, power consumption increases, which creates another concern regarding a cost increase associated with the increase of power consumption.

Patent Document 1 discloses a copying apparatus that has two auto document conveyer devices for reading the same job. Since these auto document conveyer devices share the job, an improvement in the operability can be achieved. This is only directed to the conveying of documents. Unless efficiency is achieved with respect to other processes associated with the copying, the entirety of the copying operation may come to a stop, and a sufficient solution to the above problem may not be provided. There is also no mention of the problem of cost increase.

[Patent Document 1] Japanese Patent Application Publication No. 03-264434

Accordingly, there is a need to improve work efficiency with respect to a sequence of processes associated with a copying operation while suppressing costs.

SUMMARY OF THE INVENTION

It is a general object of the present invention to provide an image forming apparatus that substantially obviates one or more problems caused by the limitations of the related art.

Features and advantages of the present invention will be presented in the description which follows, and in part will become apparent from the description and the accompanying drawings, or may be learned by practice of the invention according to the teachings provided in the description. Objects as well as other features and advantages of the present invention will be realized and attained by image forming apparatus particularly pointed out in the specification in such full, clear, concise, and exact terms as to enable a person having ordinary skill in the art to practice the invention.

To achieve these and other advantages in accordance with the purpose of the invention, the invention provides an image forming apparatus which includes two or more detachable components that are identical to each other and configured to perform at least part of a sequence of processes associated with forming of an image, a connection detection unit configured to detect attaching of the components, and a first control unit configured to control the sequence of processes, wherein a software-based controller for controlling one of the components is generated in response to detection by the connection detection unit of the attaching of the one of the components.

According to one aspect of the present invention, one of the components is a scanner unit configured to illuminate a document and to produce image data based on light reflected from the illuminated document, and the controller is a scanner unit controller configured to control the scanner unit, and wherein the first control unit includes a first memory unit for storing information about the scanner unit.

According to another aspect of the present invention, one of the components is an operation/display unit configured to receive a predetermined input and to display a predetermined content, and another one of the components is a scanner unit configured to illuminate a document and to produce image data based on light reflected from the illuminated document, and wherein the first controller sets a correspondence between the operation/display unit and the scanner unit that operates in response to an input from the operation/display unit.

According to at least one embodiment of the present invention, work efficiency can be improved with respect to a sequence of processes associated with a copying operation while suppressing costs.

BRIEF DESCRIPTION OF THE DRAWINGS

Other objects and further features of the present invention will be apparent from the following detailed description when read in conjunction with the accompanying drawings, in which:

FIG. 16 is a flowchart of an operation performed by the system control unit when the power of a plurality of detachable imaging units is switched on;

FIG. 17 is a table showing an example of the relationships between the imaging units and the power supply control units that correspond to the imaging units;

FIG. 21A is a table showing the relationships between the power supply control units and the corresponding units;

FIG. 21B is a table showing the usage status of a corresponding unit;

FIG. 25 is a table showing the relationships between the amount of printouts and the number of imaging units that are simultaneously activated.

DESCRIPTION OF THE PREFERRED EMBODIMENTS

In the following, preferred embodiments for implementing a copy machine will be described by using the copy machine as an example of the image forming apparatus of the present invention. In the following description, drawings accompanying the present specification will be referred to as appropriate.

Figure 1:
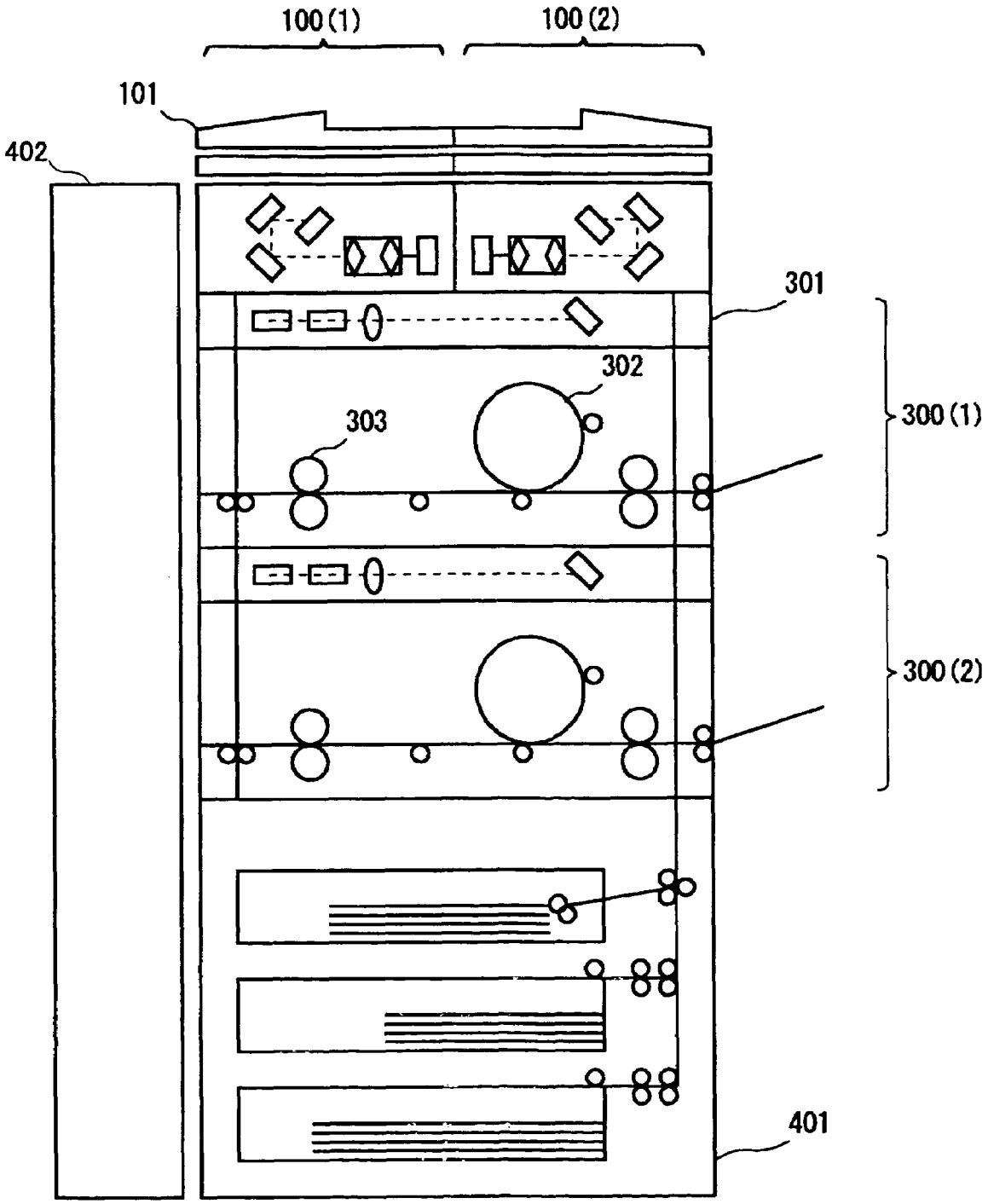
FIG. 1 is an entire view of a copy machine.

FIG. 1 is an entire view of a copy machine. The copy machine is a blade type apparatus equipped with components such as a plurality of scanner units (100(1), 100(2)) and imaging units (300(1), 300(2)) per machine. The number of the components may be determined as a matter of choice according to the specification of the copy machine. A sheet feeder unit 401 and an automatic sorting unit 402 may be provided in addition to the scanner units 100(1) and 100(2), operation/display units 200(1) and 200(2) (not shown), and the imaging units 300(1) and 300(2). For the sake of simplicity of explanation, the sheet feeder unit 401, the automatic sorting unit 402, and other peripheral device units that constitute the copy machine but have no direct connection with an image forming processing will be collectively referred to as a peripheral unit 400.

The scanner units 100(1) and 100(2) are each provided with an auto document feeder unit 101. Each of the scanner units 100(1) and 100(2) performs a scan by illuminating a document by use of a light source, and detects the light reflected from the document by use of a CCD (charged coupled device) The scanner units 100(1) and 100(2) then perform image processing, followed by supplying the image data generated by the image processing to the imaging units 300(1) and 300(2), respectively. Alternatively, provision may be made such that only one auto document feeder unit 101 is provided and shared by the scanner units 100(1) and 100(2).

Figure 2:
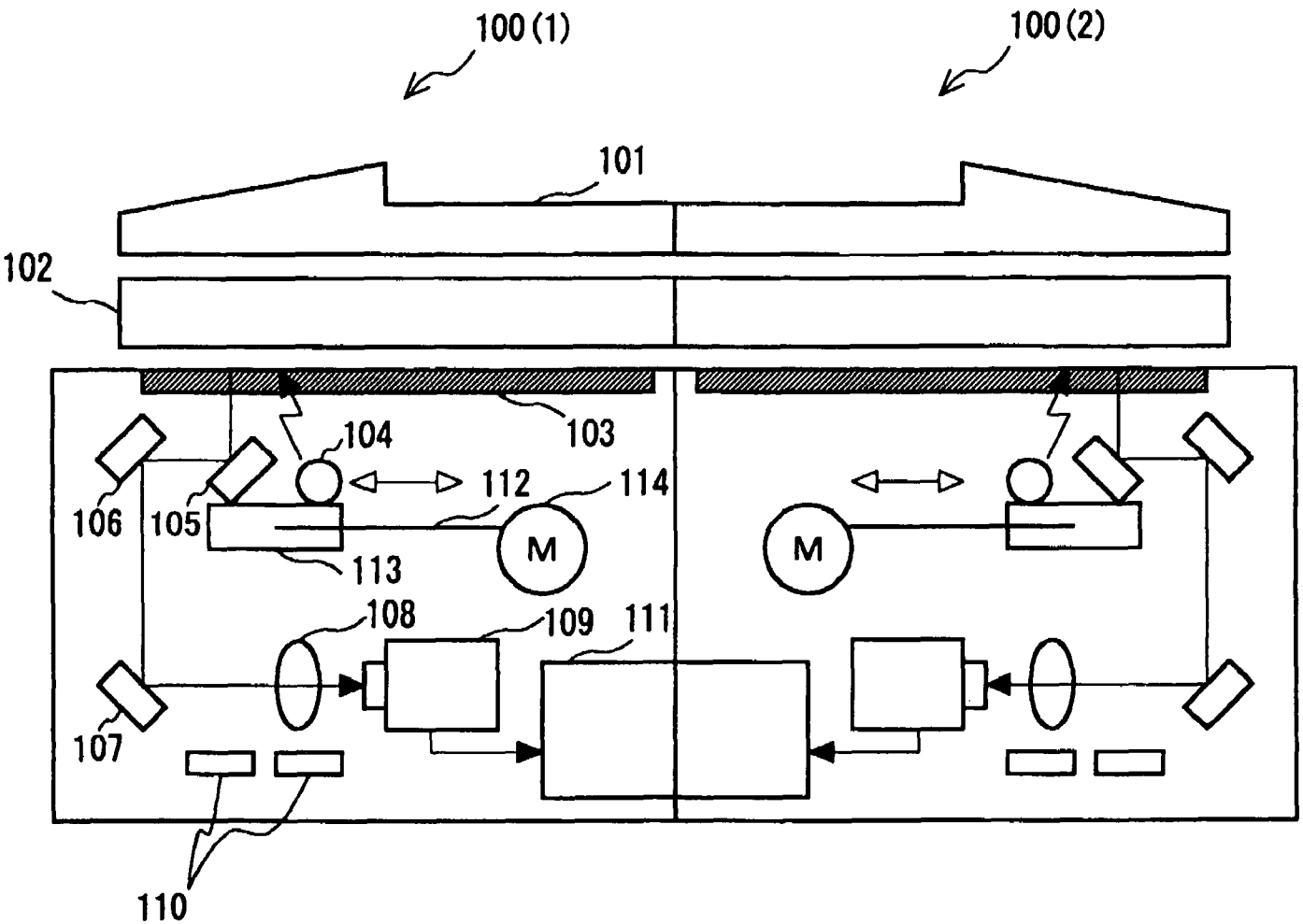
FIG. 2 is a drawing showing an internal configuration of scanner units.

The detail of the scanner units 100(1) and 100(2) will be described below. FIG. 2 is a drawing showing an internal configuration of the scanner units 100(1) and 100(2). Since the scanner units 100(1) and 100(2) have the same configuration, the scanner unit 100(1) will be described as a representative example The scanner unit 100(1) includes the auto document feeder unit 101, a pressure plate 102, a contact glass 103, an exposure lamp 104, mirrors 105, 106, and 107, a lens 108, a CCD 109, a document size sensor 110, an image processing unit 111, a wire 112, a traveling unit 113, and a motor 114.

The pressure plate 102 serves to hold down the document placed on the contact glass 103. When there is no document, the pressure plate 102 serves to protect the contact glass 103. Light emitted from the exposure lamp 104 is reflected on the surface of the document placed on the contact glass 103, and is directed to the mirrors 105, 106, and 107. The exposure lamp 104 and the mirror 105 are carried on the traveling unit 113. The traveling unit 113 moves in directions shown by the arrows in FIG. 2 through the wire 112 in response to the rotation of the motor 114, and performs a scan on the document surface in the sub-scan direction. The document size sensor 110 includes a circuit embedded therein for detecting the size of the document placed on the contact glass 103. The reflected light is condensed by the lens 108 to be focused on the CCD 109. The focused light is converted into analog electric signals for transmission to the image processing unit 111 where necessary image processing is performed.

The "necessary image processing" includes quantization for converting the analog data of the electric signals produced by the CCD 109 into binary or multi-value data, shading correction processing for correcting the uneven illumination of the document by the light source and a variation in the sensitivity of the CCD 109, MTF correction processing for correcting blurring caused by the optical system, magnification processing for changing the sampling rate of the scanned image so as to interpolate data for the scanned image data, etc.

The operation/display units 200(1) and 200(2) are provided with a liquid crystal touch panel, a keypad, clear/stop keys, a print key, a mode clear key, etc., to receive user inputs. The liquid crystal touch panel displays function keys, the number of copies, and a message or the like indicative of the status of the image forming apparatus.

Each of the imaging units 300(1) and 300(2) modulates the driving of an LD (laser diode) 301 in response to image data. The laser beam emitted from the LD 301 draws an electro static latent image on a photoconductive drum 302, which rotates and has a surface thereof evenly charged electrically. Toner is attached to the electro static latent image for visualization. The visualized image is transferred onto a recording material such as a paper sheet or thermo-sensitive paper supplied from the sheet feeder unit 401, and is then fused by heat by use of a fuser/pressure roller 303. The recording material after the fusing process is generally ejected onto the automatic sorting unit 402.

The components that are provided in several sets such as the scanner units 100(1) and 100(2), the operation/display units 200(1) and 200(2), and the imaging units 300(1) and 300(2) are detachable. The copy machine has a connection detection sensor (not shown) to detect these components when they are attached (mounted). When the connection detection sensor detects the components connected to the machine, a system control unit 700, which will later be described, modifies the software configuration such as to perform a predetermined operation.

Figure 3:
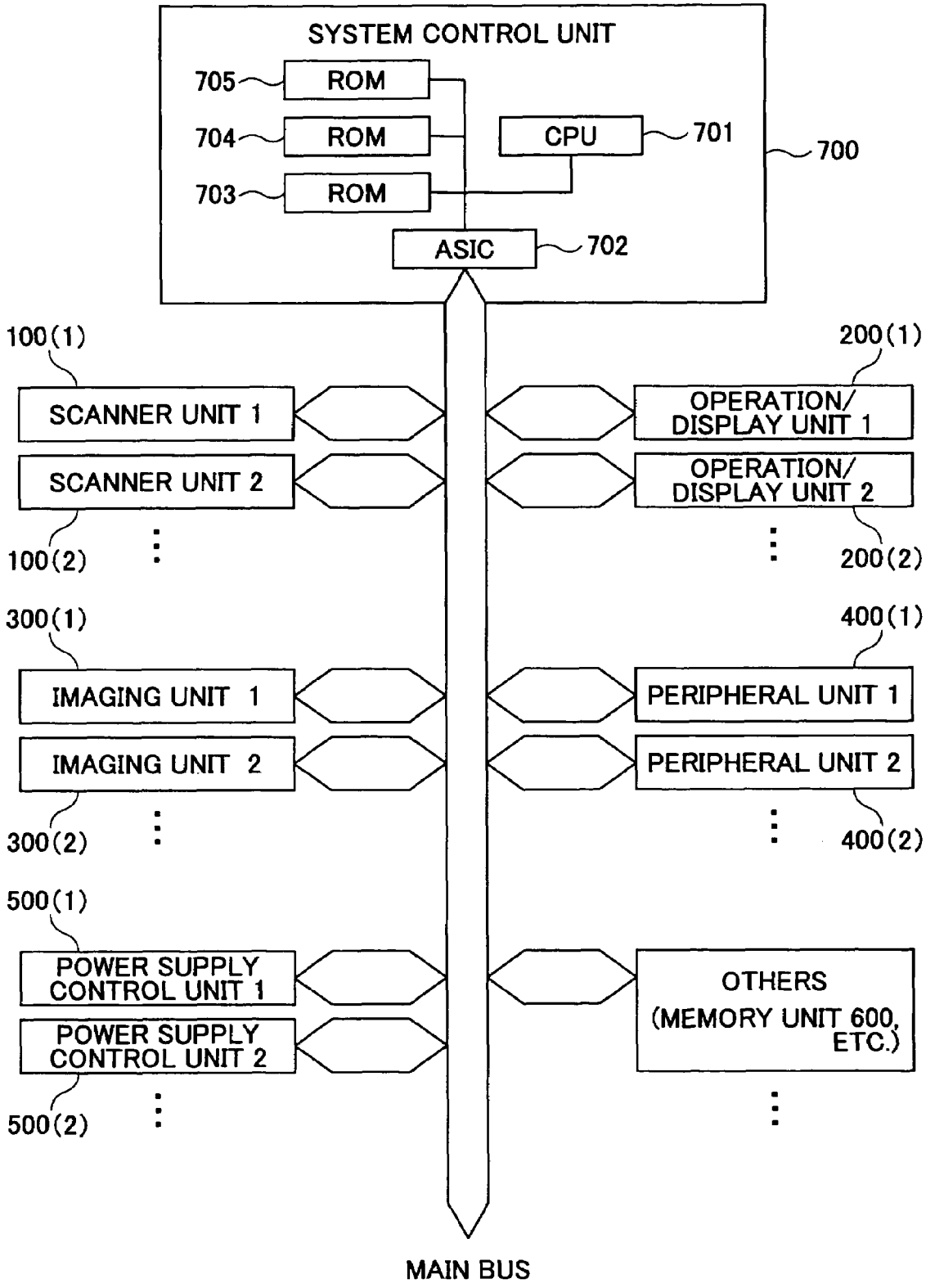
FIG. 3 is a block diagram showing the hardware configuration of the copy machine.

In the following, the hardware configuration of the copy machine according to the present embodiment will be described. FIG. 3 is a block diagram showing the hardware configuration of the copy machine. A CPU (central processing unit) 701 of the system control unit 700 controls, via a main bus, the scanner units 100(1), 100(2), . . . , the operation/display units 200(1), 200(2), . . . , the imaging units 300(1), 300(2), . . . , the peripheral units 400(1), 400(2), . . . , power supply control units 500(1), 500(2), . . . , and a memory unit 600 for storing predetermined information, which are main components that constitute the copy machine.

The power supply control units 500(1), 500(2), and so on serve to control the power supply that supplies power to the scanner units 100(1) and 100(2), the imaging units 300(1) and 300(2), the controller embedded in the system control unit 700, etc. The power supplies of the units corresponding to the power supply control units 500(1), 500(2), and so on can be turned on/off. Details will later be described.

The system control unit 700 includes the CPU 701, an ASIC (Application Specific Integrated Circuit) 702, a RAM (Random Access Memory) 703, and ROMs (Read Only Memories) 704 and 705 that are provided in accordance with the contents and numbers of applications to be executed.

The CPU 701 writes settings to a memory unit controller or the like embedded in the ASIC 702, writing/reading data to/from the image memory 704 via the memory unit controller, and also controlling the scanner units 100(1) and 100(2) and the like. The ASIC 702 has an I/O port embedded therein that allows the CPU 701 to exchange information with peripheral devices, and communicates with the main bus serving as a connecting interface. The RAM 703 is a memory device that temporarily stores data necessary for a sequence of processes performed by the copy machine. The RAM 703 may be provided separately from the image memory. The ROMs 704 and 705 are memory medium that store the programs to perform control based on the CPU 701.

In the present embodiment, the imaging units 300(1) and 300(2) form images for the purpose of performing the copy mode. To this end, a controller monitors a paper conveyer process, the failure state of an electrophotographic process, the state of a paper feeding cassette (e.g., presence/absence of paper sheets), etc., and controls the scanner operation and the ON/OFF operation of the light source for the purpose of using the scanner units 100(1) and 100(2) to scan images. Such controller is referred to as a "system control unit". In digital PPCs available today, further, a plurality of applications are tend to be provided simultaneously, rather than only a single extension function being provided. Such a digital PPC that shares a single resource is referred to as a "system", and a controller for controlling such system may also be referred to as a "system control unit" from time to time.

Figure 4:
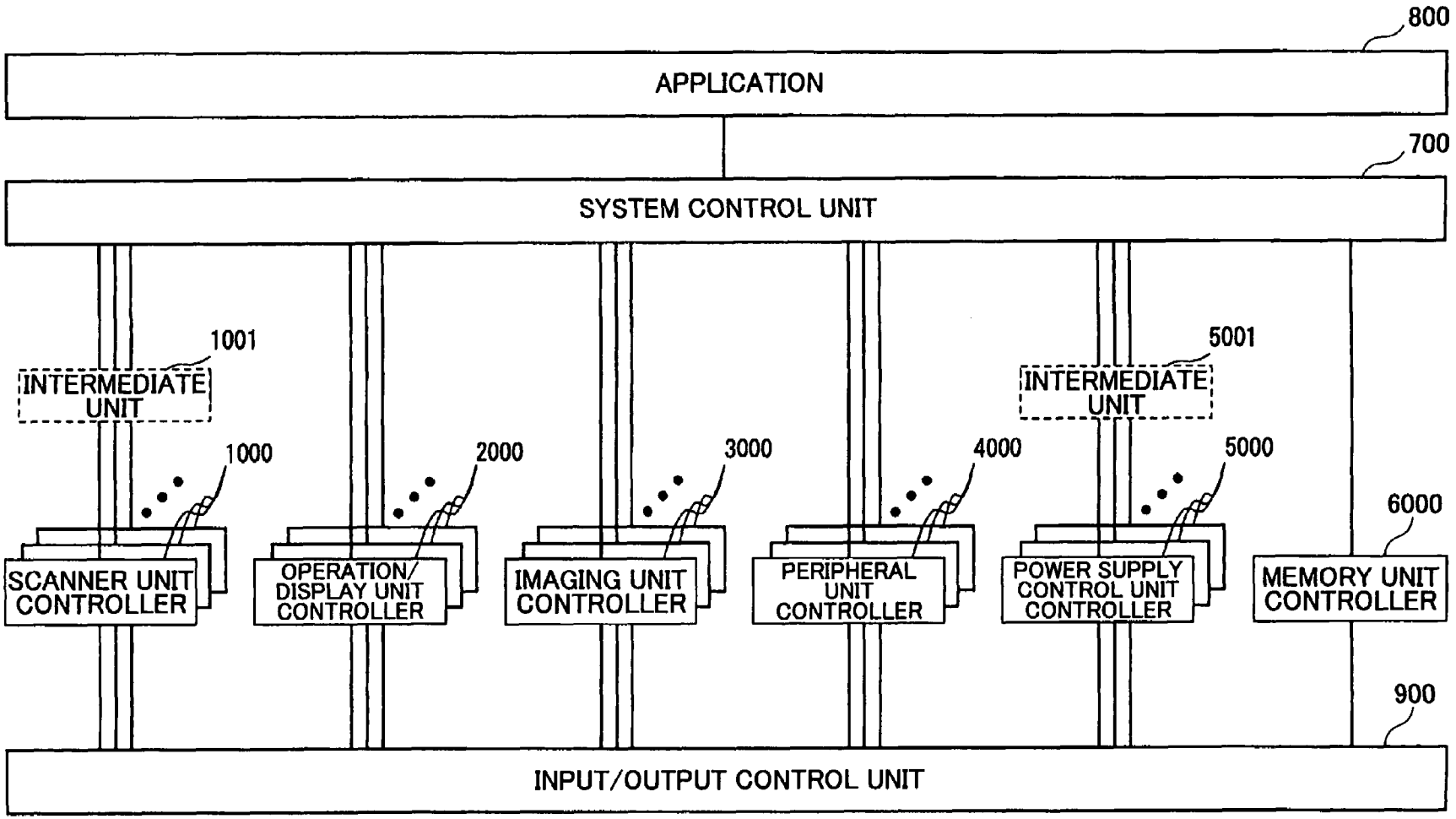
FIG. 4 is a block diagram showing the software configuration of the copy machine.

In the following, a description will be given of the software of the copy machine according to the present embodiment. FIG. 4 is a block diagram showing the software configuration of the copy machine. The software includes an application 800, an input/output control unit 900, a scanner unit controller 1000, an operation/display unit controller 2000, an imaging unit controller 3000, a peripheral unit controller 4000, a power supply control unit controller 5000, and a memory unit controller 6000, in addition to the system control unit 700 which was previously described.

The application 800 is a layer that is used to refer collectively to each application implemented on the image forming apparatus such as a copy application for performing a copy sequence representing a copying operation. The application 800 is stored as programs in the recording medium such as the ROMs 704 and 705. The input/output control unit 900 serves as a device driver, and is a layer that performs the logical and physical conversion of predetermined data.

The scanner unit controller 1000 is a layer that controls the scanner units 100(1), 100(2), and so on at the logical level. The operation/display unit controller 2000 is a layer that serves as a MMI (man machine interface) to control the operation/display units 200(1), 200(2), and so on. The operation/display unit controller 2000 performs LCD display, LED light-on/off, key input scan, etc., at the logical level. The imaging unit controller 3000 is a layer that controls the imaging units 300(1), 300(2), and so on at the logical level. The peripheral unit controller 4000 is a layer that controls the peripheral units 400(1), 400(2), and so on at the logical level. The peripheral unit controller 4000 performs the logical-level control of peripheral units such as an auto duplex unit and a sorter, which are provided in the PPC. The power supply control unit controller 5000 is a layer that controls the power supply control units 500(1), 500(2), and so on at the logical level. The memory unit controller 6000 is a layer that controls the memory unit 600 at the logical level.

Each controller is generated separately for each of the components such as a plurality of detachable scanner units and operation/display units. Such generation occurs in response to the detection by the connection detection sensor that a component is connected (mounted). These controllers are treated as resources held in the image forming apparatus. The system control unit 700 arbitrates the right to use resources in response to requests from the application 800, and notifies the application 800 of the arbitration results (i.e., the results indicative of whether the component can be used). With the image forming apparatus being not connected to the network, i.e., operating in the standalone condition, exclusive use by the application is possible, so that the copying operation starts immediately.

The system control unit 700 is aware of which scanner unit or imaging unit is controlled by which power supply control unit. In response to instruction from the system control unit 700, the power supply control units 500(1), 500(2), and so on controls the ON/OFF state of the power supplies of the respective scanner units or imaging units.

With respect to the scanner unit controller 1000 and the power supply control unit controller 5000, intermediate units 10001 and 5001 are provided at the point of connection with the system control unit 700, respectively. The system control unit 700 needs to control the scanner units 100(1), 100(2), and so on and the power supply control units 500(1), 500(2), and so on. The intermediate units 1001 and 5001 are software that performs the control on behalf of the system control unit 700. Provision may be made that dedicated circuit devices are implemented in the scanner units 100(1), 100(2), and so on and the power supply control units 500(1), 500(2), and so on. With this provision, the system control unit 700 does not have to be attending to the scanner units 100(1), 100(2), and so on and the power supply control units 500(1), 500(2), and so on, which makes it possible to achieve flexible control and the efficient use of resources. Whether to provide intermediate units 1001 and 5001 is a matter of design choice, as will be described later in detail.

In the following, a description will be given of a copy machine in which a plurality of detachable scanner units are provided as a first example of the present embodiment. In the following, several types are disclosed as the first example. It is assumed that a document is scanned on a surface-by-surface basis (such surface will be referred to as a "document surface"). P document surfaces are scanned by n scanner units 100(1) through 100(n) ($p \geqq 0$, $n \geqq 0$). A description will be given of a case in which the scanner unit uses a shared auto document feeder unit 101.

Figure 5:
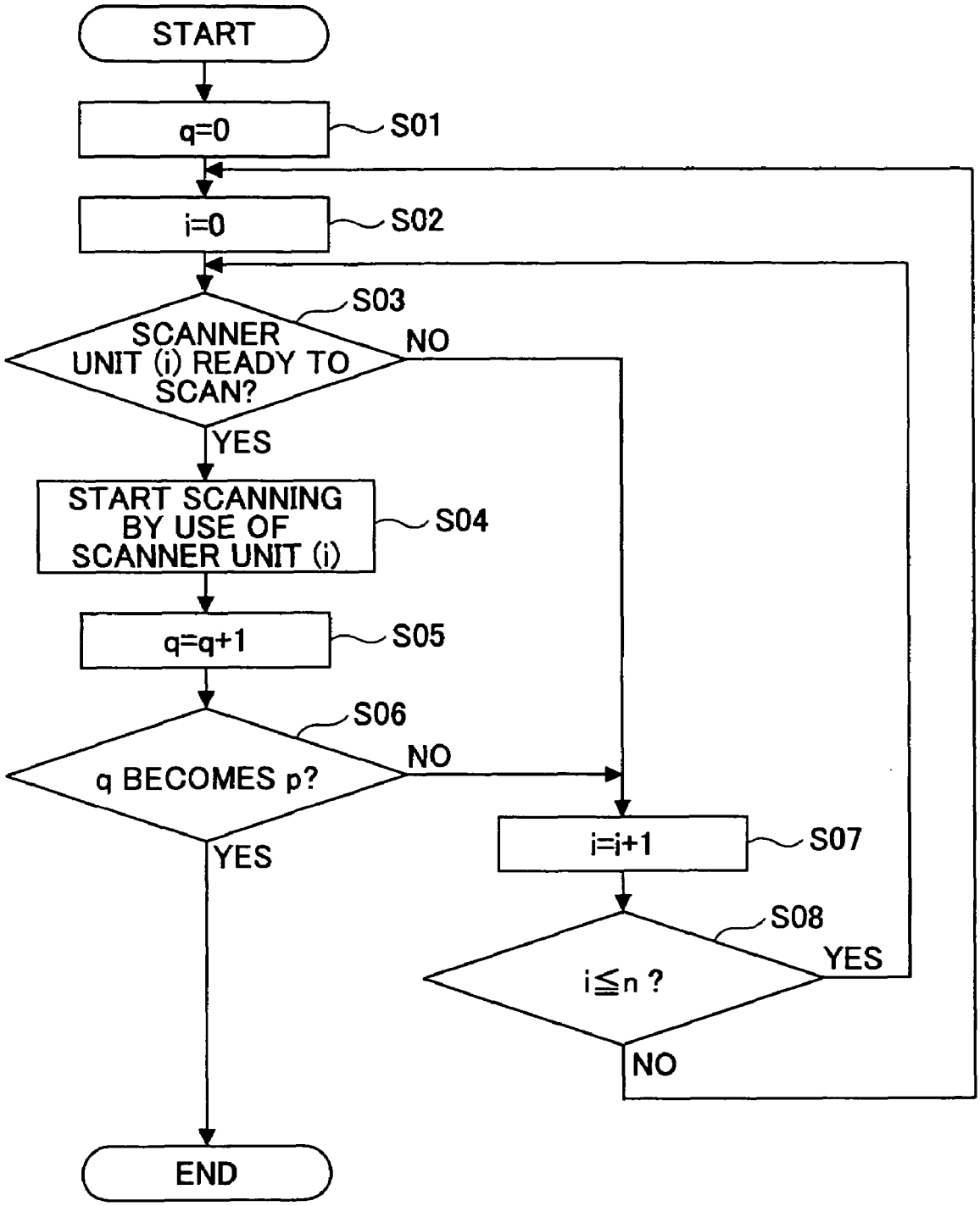
FIG. 5 is a flowchart of a process performed by a system control unit according to a first example.

FIG. 5 is a flowchart of a process performed by the system control unit 700 according to the first example. In the initial state, none of the scanner units has yet scanned a single surface of the documents. The q-th document surface of a total of the p document surfaces is set to zero as: "q=0" (S01). Further, the i-th scanner unit of a total of the n scanner units is set to zero as: "i=0" (S02).

In order to acquire the state of the i-th scanner unit (i), the system control unit 700 checks with the scanner unit controller 1000. Here, the "state" indicates whether the scanner unit is in the state of being ready to perform a scan. If any one of the parts that constitute the scanner unit (such parts including the shared auto document feeder unit 101) is not in a proper condition (No at step S03), the state of the scanner unit indicates "unable to perform a scan".

If the scanner unit (i) is ready to perform a scan (Yes at S03), instruction is given to the scanner unit (i) to scan the q-th document surface $p_q$ (S04). When the scan of the q-th document surface is completed, q is updated as: q=q+1 (S05). When q reaches p indicative of the total number of the scan surfaces (Yes at S06), the request from the system control unit 700 to the scanner unit controller 1000 comes to an end.

If q has not yet reaches p indicative of the total number of the scan surfaces (No at S06), i is updated as: "i=i+1" (S07), thereby selecting the next scanner unit to be used. If i is smaller than or equal to n indicative of the total number of the scanner units (Yes at S08), a check is made as to whether the next scanner unit (i) is ready to perform a scan, and the steps of the flow are repeated. If i is larger than n indicative of the total number of the scanner units (No at S08), i is cleared (S02), and the procedure continues.

With the provision as described above, document surfaces to be scanned are assigned to a plurality of scanner units, which makes it possible to cope with differing scan conditions, thereby improving the efficiency of the image scan. Even if any one of the scanner units is in the state of being unable to perform a scan, the request for scan is successfully attended to without calling off the scan as long as the remaining scanner units are ready to perform a scan.

Figure 6:
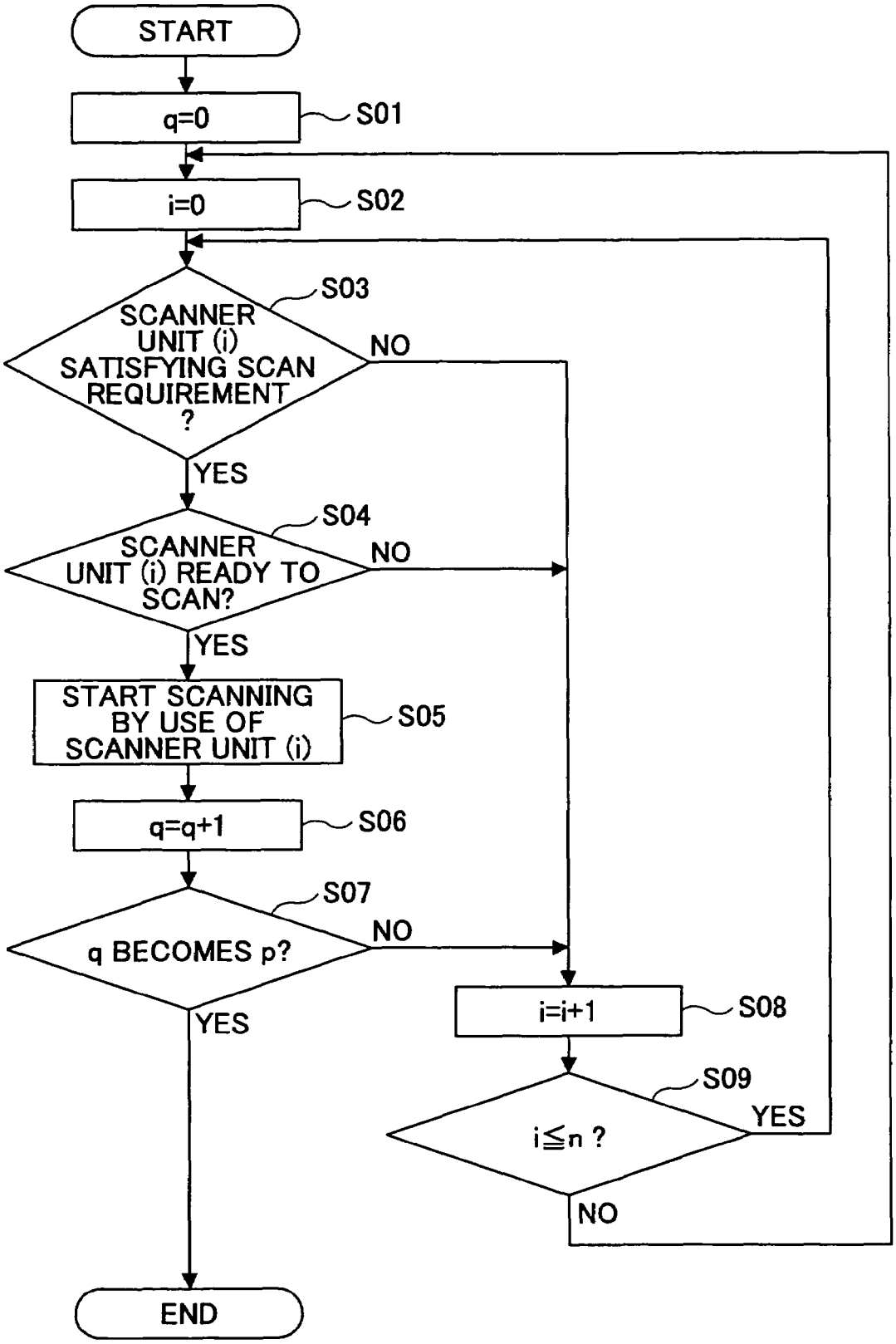
FIG. 6 is a flowchart of another process performed by the system control unit according to the first example.

FIG. 6 is a flowchart of another process performed by the system control unit 700 according to the first example.

This flowchart differs from the process of FIG. 5 only in that processing step S03 is additionally provided. Namely, the system control unit 700 has information about all the scanner units in the RAM 703, and, at step S03, checks based on this information whether the i-th scanner unit (i) can scan the document surface $p_q$. For example, when the document surface $p_q$ is to be scanned in color, the scanner unit (i) may only be capable of performing a monochrome scan. In such a case, i is updated as: i=i+1 (S09), followed by the same check until a scanner unit satisfying the requirement is found. Other steps are the same as those described in connection with FIG. 5, and a description thereof will be omitted.

With the configuration that the system control unit 700 has information about all the scanner units, the system control unit 700 can manage and control the scanner units collectively, thereby being able to assign jobs to suitable scanner units.

Figure 7:
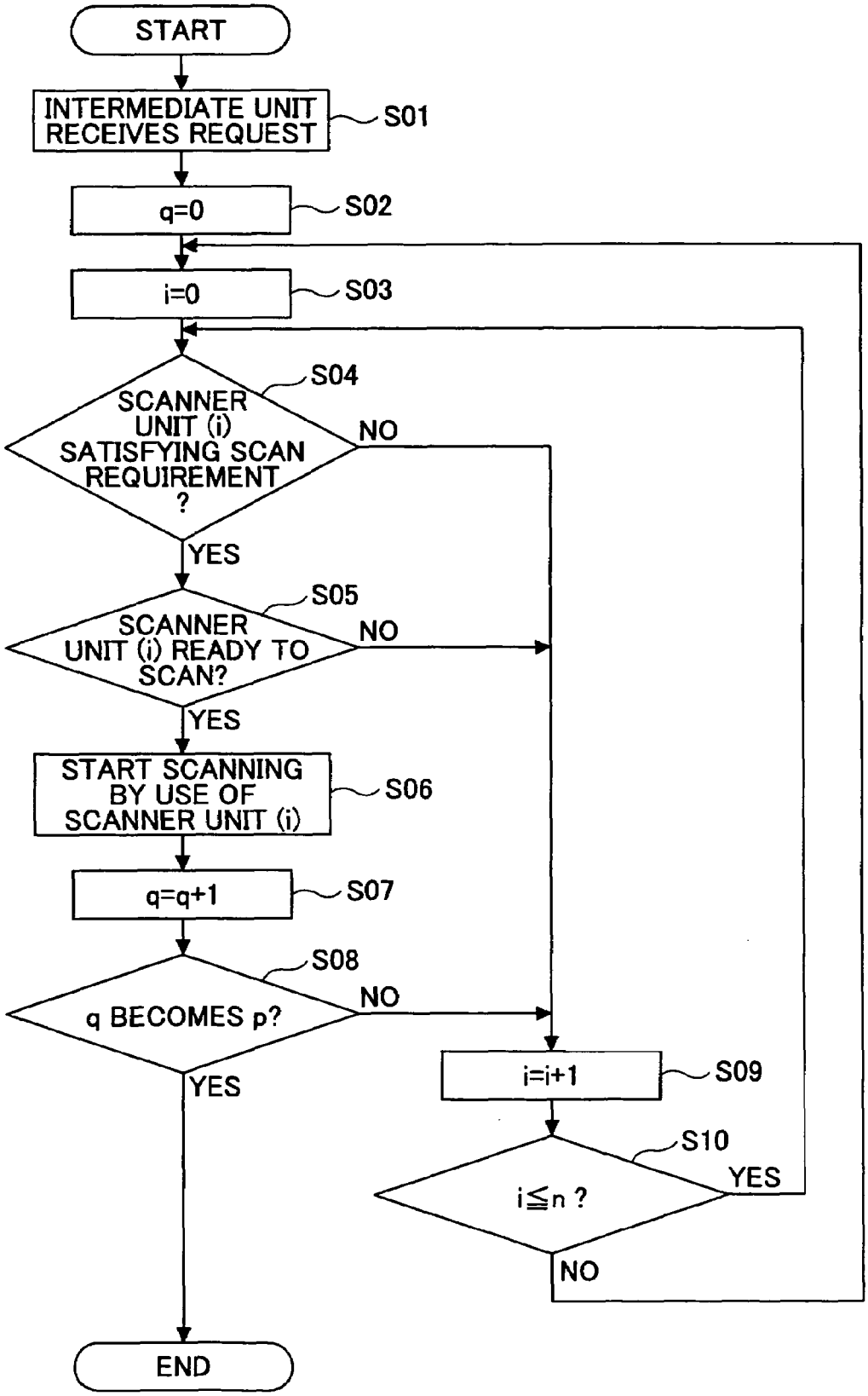
FIG. 7 is a flowchart of another process according to the first example.

FIG. 7 is a flowchart of another process according to the first example. In this process, the intermediate unit 1001 performs predetermined control with respect to the scanner unit controller 1000 on behalf of the system control unit 700.

This flowchart differs from the flowchart of FIG. 6 only in that processing step S01 is additionally provided. Namely, at step S01, the intermediate unit 1001 receives a scan request from the system control unit 700. Other steps are the same as those described in connection with FIG. 6, and a description thereof will be omitted.

As described above, the intermediate unit 1001 is provided between the system control unit 700 and the scanner unit controller 1000, and holds information about all the scanner units. With this provision, the system control unit 700 can scan an image by performing the same control with respect to the intermediate unit 1001 without a need to attend to differences between the scanner units. This reduces the process load on the system control unit 700.

In the process performed by the intermediate unit 1001 described above, the information about the scanner units held by the intermediate unit 1001 may as well be stored in the memory unit 600. In this case, at S05 of FIG. 6, the intermediate unit 1001 issues a request to the memory unit controller 6000, and checks based on the information stored in the memory unit 600 whether the i-th scanner unit (i) can scan the document surface $p_q$. Other steps are the same as those described in connection with FIG. 6, and a description thereof will be omitted.

With the configuration that the memory unit controller 6000 rather than the intermediate unit 1001 holds information about all the scanner units, there is no need to provide a memory device in the intermediate unit 1001, thereby reducing the cost of the intermediate unit 1001 by an amount equal to the memory unit. Further, the system control unit 700 can scan an image by performing the same control all the time with respect to the intermediate unit 1001 without a need to attend to differences between the scanner units. This reduces the process load on the system control unit 700.

In the following, a description will be given of a copy machine in which a plurality of detachable scanner units are provided as a second example of the present embodiment. In the following, several types are disclosed as the second example.

Figure 8:
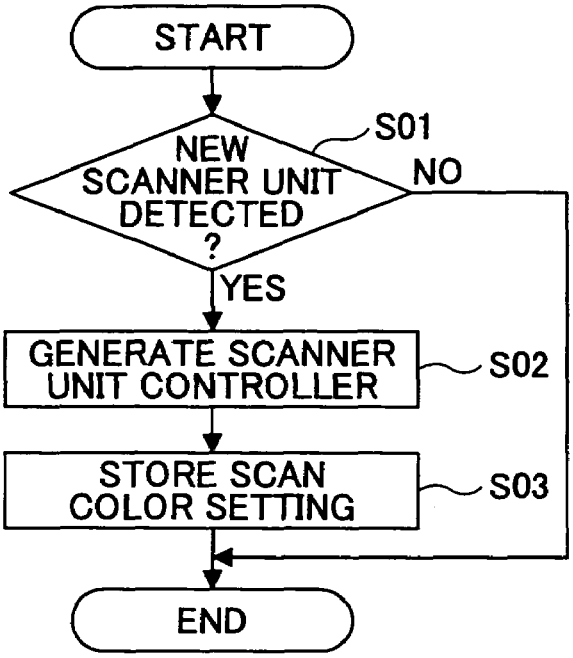
FIG. 8 is a flowchart of a process performed according to a second example.

FIG. 8 is a flowchart of a process performed according to the second example. This process may normally be performed by the system control unit 700, but may as well be performed by the intermediate unit 1001.

When a new scanner unit is mounted on a copy machine at the time of power-on or during operation (Yes at S01), the system control unit 700 or the intermediate unit 1001 generates a scanner unit controller 1000 corresponding to the newly mounted scanner unit (S02). Thereafter, information about the scan color settings of the scanner units 100(1), 100(2), and so on are stored in the memory unit 600 (S03). The information about the scan color settings stored in the memory unit 600 may alternatively be managed under the control of the memory unit controller 6000. With this provision, an efficient image scan can be performed based on the stored information. Here, the "scan color settings" refer to settings regarding the color system used to scan a document such as an indication specifying the full color scan of a document or the black-&-white scan of a document.

Figure 9:
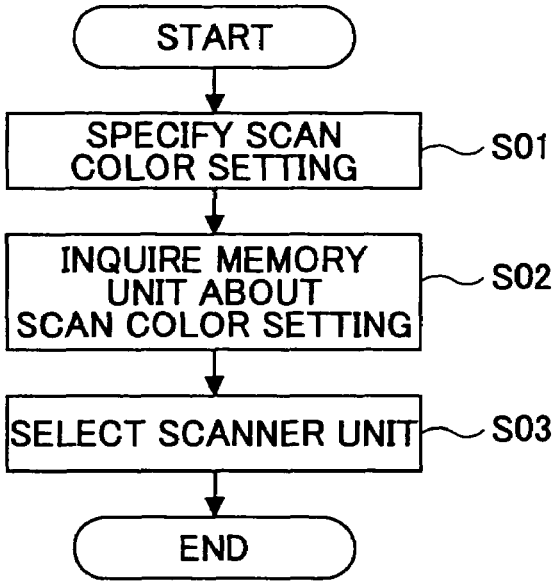
FIG. 9 is a flowchart of another process performed according to the second example.

FIG. 9 is a flowchart of another process performed according to the second example. A user enters data by use of the operation/display unit 200 to specify the scan color settings (S01). In response, the system control unit 700 or the intermediate unit 1001 inquires about the scan color settings stored in the memory unit 600 (S02). Thereafter, the scanner unit 100 that matches the scan color settings specified by the user is automatically selected (S03). A plurality of scanner units may be selected as appropriate.

In this manner, the scanner unit to be used is selected based on the scan color settings. This eliminates a need for the user to know which scanner unit needs to be used to perform a scan to achieve desired scan color settings. This improves the operability.

Figure 10:
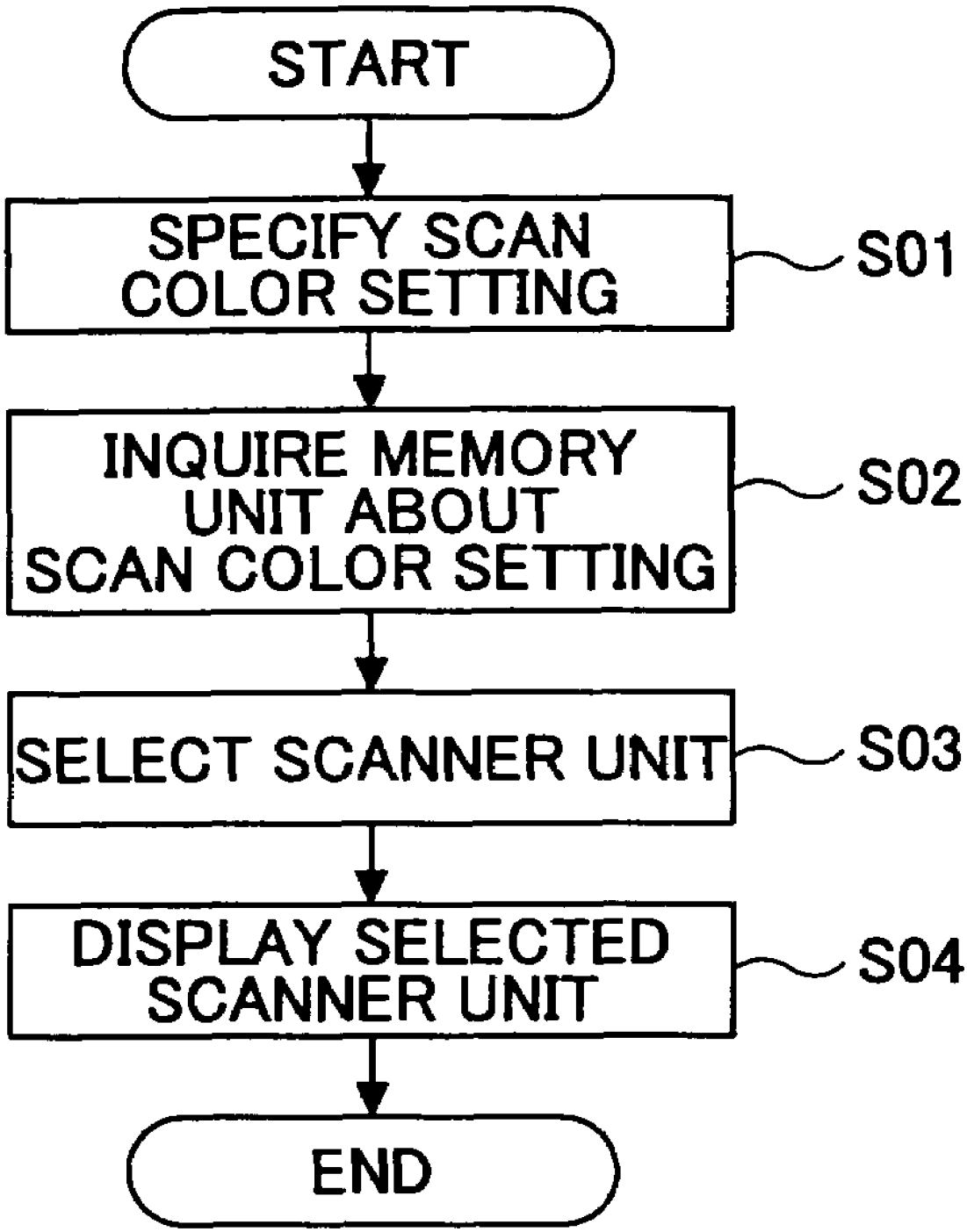
FIG. 10 is a flowchart of another process performed according to the second example.

FIG. 10 is a flowchart of another process performed according to the second example. The steps from S01 to S03 are the same as those described in connection with FIG. 9. After these, the selected scanner units 100 are displayed on the liquid crystal display of the operation/display unit 200 (S04). Accordingly, the liquid display serves as a notification means in one form or anther. The presentation of the information may be done by use of letters, pictures, animated display, or the like.

With the configuration that the scanner units selected based on the scan color settings are displayed, the user can select a scanner unit as he/she desires. This eliminates a need for the user to learn how to operate the machine, which would be necessary when using a scanner unit that is new to him/her.

Figure 11:
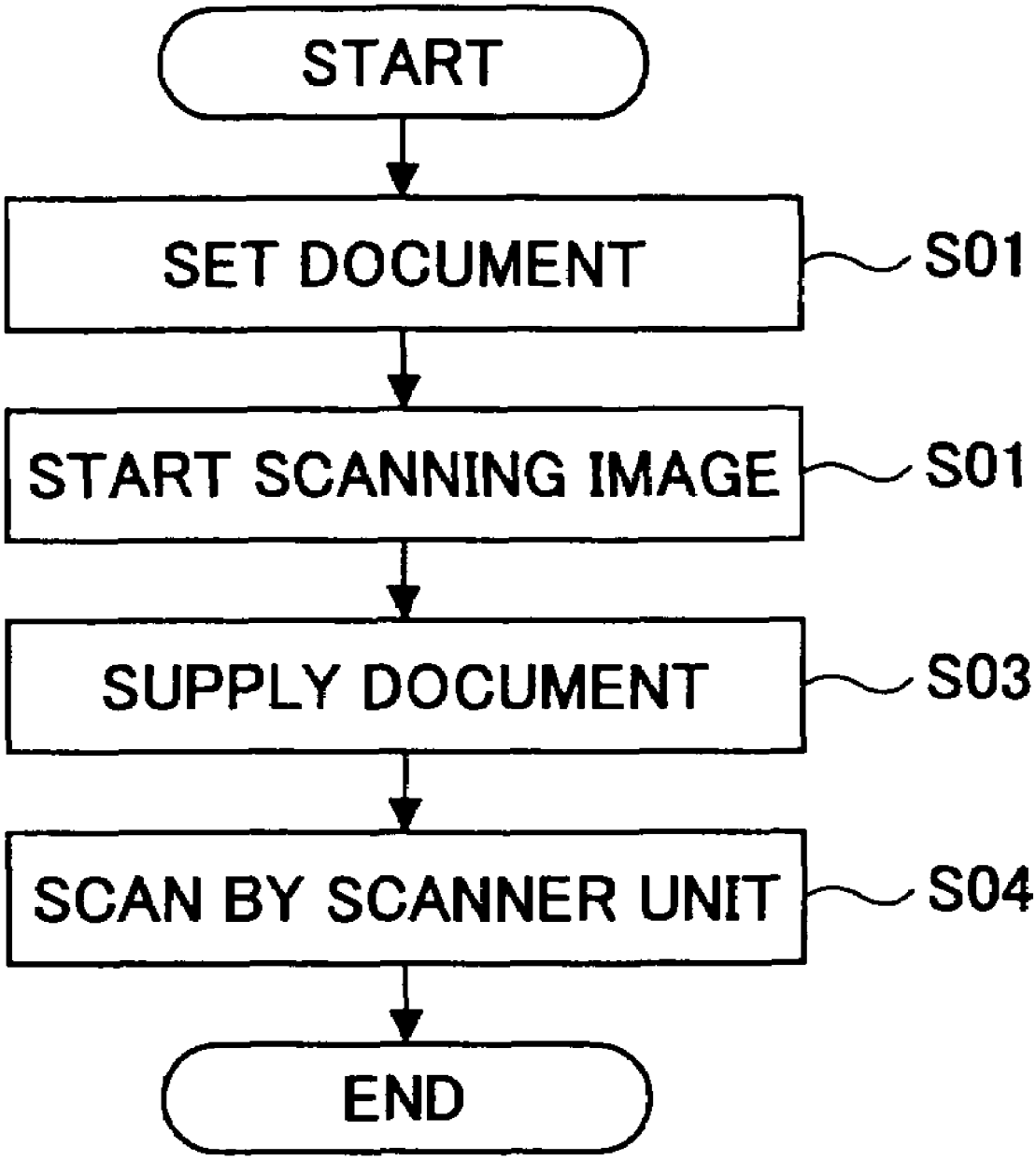
FIG. 11 is a flowchart of another process performed according to the second example.

FIG. 11 is a flowchart of another process performed according to the second example. The user places a document on the auto document feeder unit 101 shared by the scanner units 100(1), 100(2), and so on (S01). The selected scanner unit 100 starts scanning (S02). The image forming apparatus supplies the document to the selected scanner unit 100 by use of the auto document feeder unit 101 (S03). The scanner unit 100 scans the image (S04). If there are a plurality of selected scanner units, the scan may be performed by supplying the document to only one of these scanner units, or may be performed by supplying the document successively to the plurality of selected scanner units one unit after another.

With the configuration that a document is automatically supplied to a scanner unit selected based on the scan color settings, automatic sorting based on the scan color settings can be made even if the document is a mixture of a document desired to be scanned in color and a document desired to be scanned in back and white. This improves scan efficiency.

In the following, a description will be given of a copy machine in which a plurality of detachable operation/display units are provided as a third example of the present embodiment. In the following, several types are disclosed as the third example. In the configuration in which no extension is added to the components constituting the copy machine, only a single set of the system control unit 700, the scanner unit 100, the operation/display unit 200, and the imaging unit 300 is provided. In this embodiment, extensions are added to the scanner unit 100 and to the operation/display unit 200. In this embodiment, the term "extension" refers to the fact that an additional set of the scanner unit 100 and the operation/display unit 200 is mounted on the image forming apparatus. The number of extensions is not limited to one, and may be any plural number.

Figure 12:
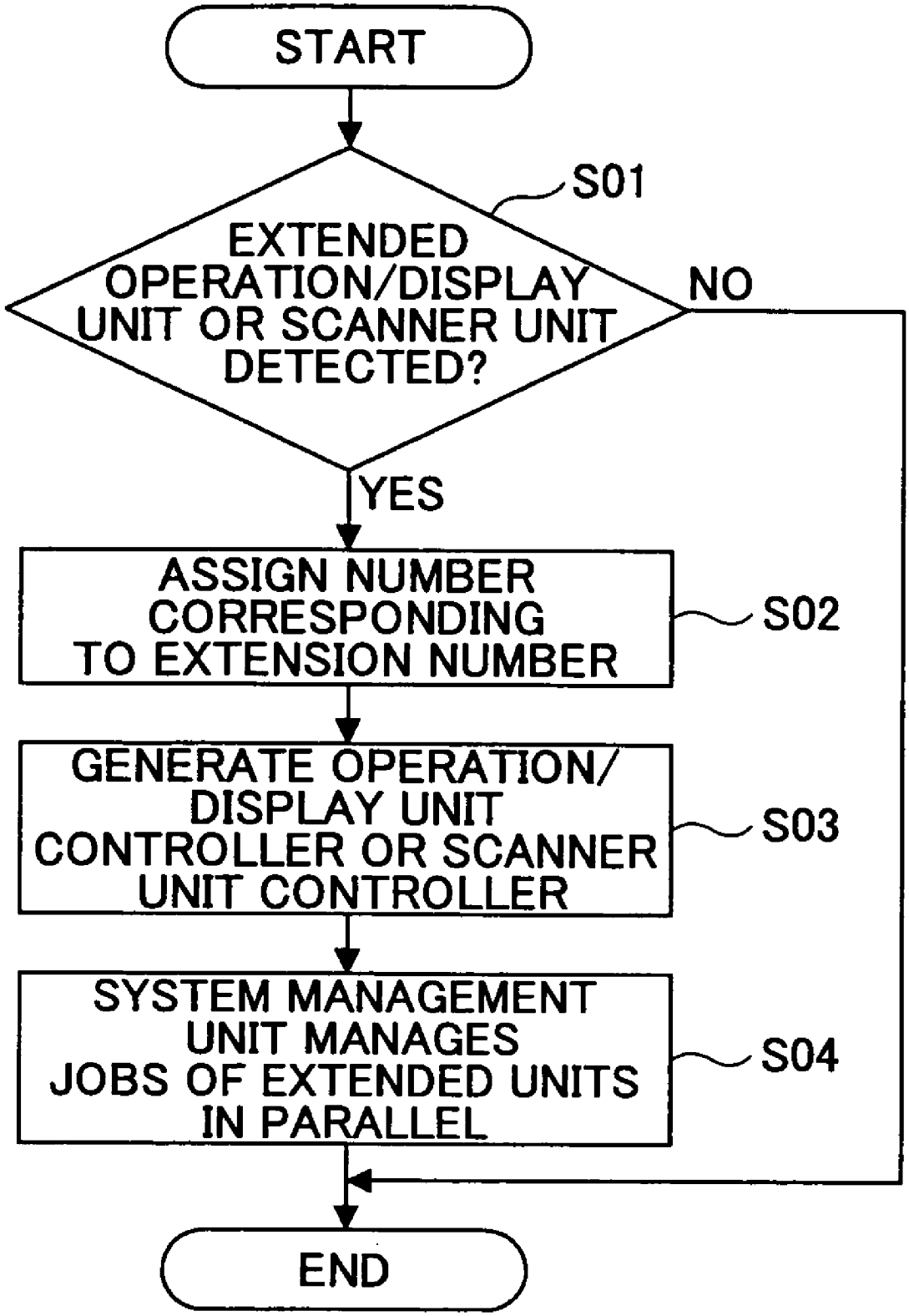
FIG. 12 is a flowchart showing a process performed according to a third embodiment.

FIG. 12 is a flowchart showing a process performed according to a third embodiment. The connection detection sensor detects the mounting of an extension set of a scanner unit 100 and an operation/display unit 200 (Yes at S01), the system control unit 700 assigns a sequence number corresponding to the extension sequence number (S02) Then, controllers corresponding to the extended scanner unit 100 and the extended operation/display unit 200, i.e., the scanner unit controller 1000 and the operation/display unit controller 2000, are generated (S03). By use of these, the system control unit 700 controls and manages the extended scanner unit 100 and the extended operation/display unit 200 (S04). This control and management is performed independently of another extension unit (the scanner unit 100 and the operation/display unit 200). When a predetermined input is received, thus, processes are performed in parallel.

It is the system control unit 700 that generates new controllers, and it is the CPU 701 of the system control unit 700 that is mainly in charge of control. As these controllers are allocated, independent scan operations can be performed separately for each of the extension units. With this provision, the extension unit may perform a scan and accept operation inputs while the default scanner unit and operation/display unit (i.e., the scanner unit 100 and the operation/display unit 200 as originally provided before the extension is added) may scan a document. If a plurality of imaging units 300 are provided, actual printing jobs can be performed in parallel. The system control unit 700 handles a job with respect to the scanner unit and operation/display unit. If jobs are thrown in parallel, the system control unit 700 controls and manages these jobs in parallel, thereby achieving the operation as described above.

By performing the operations as described above, jobs are performed separately from each other for each set of the scanner unit 100 and the operation/display unit 200. This makes it possible to eliminate a wait time by performing a user scan operation before the ongoing user print process is completed.

In this third example, a memory unit for storing jobs may be provided in the operation/display unit 200. After a job is determined for each scanner unit 100 and operation/display unit 200 according to the flowchart of FIG. 12, this job may be stored in such memory unit.

With the provision as described above, when no print process can be performed in a given copy machine due to jamming, the lack of toner, the presence of an ongoing lengthy job, etc., a detachable operation/display unit 200 may be attached to another copy machine so as to use this copy machine to perform a print process. Here, a print process should be so designed that printing can be performed by attaching an operation/display unit 200 without having the scanner unit 100.

In this third example, an SOC (System-On-Chip) may be provided for the purpose of editing the operation/display unit 200. This SOC is a single chip into which a CPU, ASIC, and RAM are consolidated, and has functions specific to image forming apparatuses. Further, a backup-purpose RAM for storing jobs may be provided in the system control unit 700. The SOC provides for scanned images to be presented as thumbnail images on the operation/display unit 200, and also serves to allow the titles and characters to be edited and added. When there are two image forming apparatuses, the operation/display units 200 having SOCs with different functions for different operation/display units 200 may be used and switched according to need. There is thus no need to provide an SOC with an exhaustive list of functions cramped together in a single operation/display unit 200, which results in cost reduction. When the operation/display unit 200 is to be exchanged, the job may be stored in the backup-purpose RAM 703 of the image forming apparatus, and may then be retrieved for editing after the unit exchange.

With the provision as described above, the loss of time and the stress of users can be reduced. Further, there is no need to provide an SOC having all the functions cramped together for each operation/display unit 200, which makes it possible to achieve necessary functions at low cost.

In the following, a description will be given of a copy machine in which a plurality of detachable operation/display units are provided as a fourth example of the present embodiment. In the following, several types are disclosed as the fourth example. In the fourth example, a copy machine in which an extension set of the scanner unit 100 and the operation/display unit 200 is mounted will be used in the same manner as in the third example. In the fourth example, the ROM 705 stores ID identification data. Here, "ID identification data" is data that specifies IDs for uniquely identifying users who use the copy machine. Unique information is stored as IDs. Unique information refers to the name of an ID holder, the mail address of a PC (personal computer), and information necessary to conduct communication between an operation/display unit 200 and the image forming apparatus when the operation/display unit 200 is disconnected therefrom.

Figure 13:
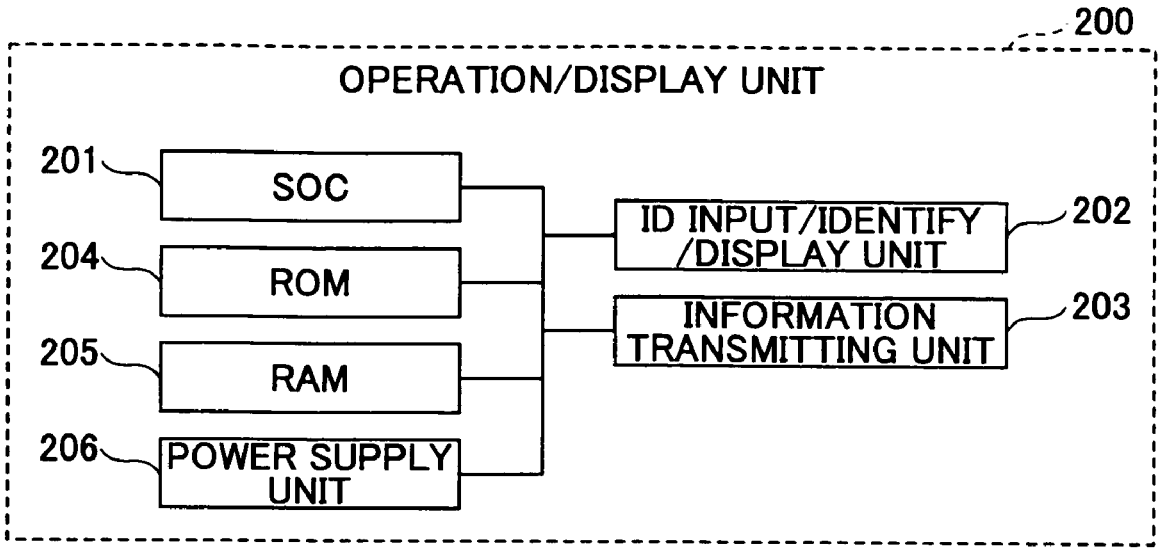
FIG. 13 is a drawing showing an internal configuration of an operation/display unit.

The functions of the operation/display unit 200 will be described with reference to FIG. 13. FIG. 13 is a drawing showing an internal configuration of the operation/display unit 200. The operation/display unit 200 includes an SOC 201, an ID input/identify/display unit 202, an information transmitting unit 203, a ROM 204, a RAM 205, and a power supply unit 206. The SOC 201 has the same functions as the one described in the third example. When the operation/display unit 200 is disconnected, the SOC 201 controls the operation/display unit 200. The ID input/identify/display unit 202 serves to receive an ID as it is entered by the user, to register and confirm the user, and to display ID-based unique information (hereinafter referred to as "ID information") such as the name of the user. The information transmitting unit 203 serves to conduct radio communication with the image forming apparatus to exchange information even when it is disconnected. The ROM 204 is a memory medium having predetermined programs stored therein, and is read by the SOC 201 when it is disconnected. The RAM 205 is a memory device that temporarily stores information input by users. The power supply unit 206 has the function to supply an electric power to drive the operation/display unit 200.

Figure 14:
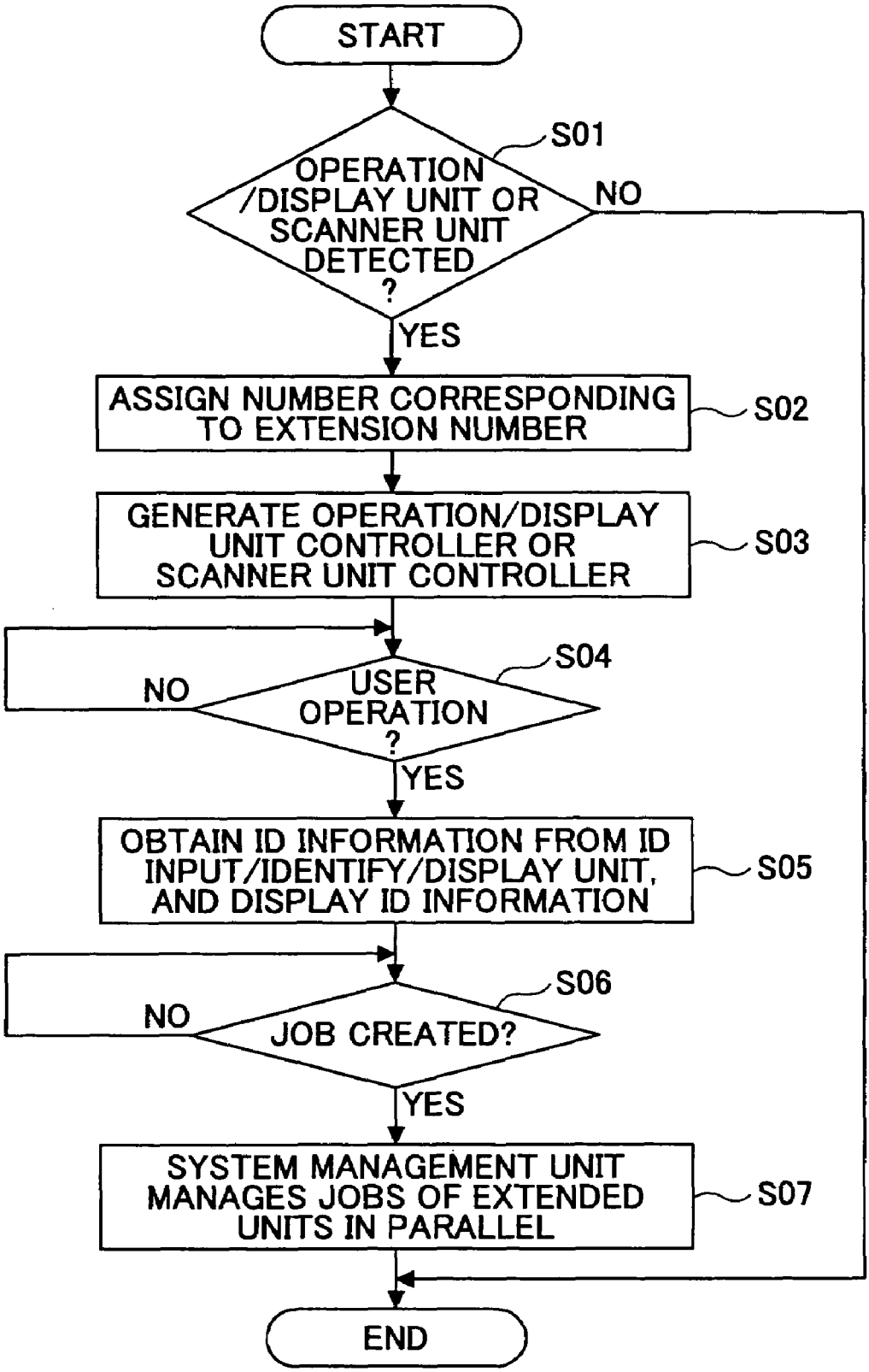
FIG. 14 is a flowchart of a process performed according to a fourth example.

FIG. 14 is a flowchart of a process performed according to the fourth example. When an extension is added as described above (Yes at S01), the system control unit 700 assigns a sequence number corresponding to the extension sequence number (S02). The scanner unit controller 1000 and the operation/display unit controller 2000 are newly generated, and, at the same time, are allocated to the respective extension units for control thereof (S03). This makes it possible to perform a scan and accept operation inputs separately for each of the extension units.

Thereafter, a user enters a predetermined input such as ID information into the operation/display unit 200 for the purpose of performing a copy operation (Yes at S04). In response, the ID input/identify/display unit 202 receives and displays the ID information (S05). If a job such as copying is created (Yes at S06), the system control unit 700 performs a copy process in response to the job. In so doing, copy processes are performed in parallel through per-extension-unit management (S07).

With the provision as described above, no job can be created unless ID information is entered and authenticated. In other words, jobs are designed such as to reveal whose jobs they are. Since user names corresponding to jobs are always presented on the operation/display unit 200, a user who wishes to create a new job can know which user is running a lengthy job when the printing of a large volume document does not appear to come to an end soon, for example. The user thus can ask if his/her job could be performed first by suspending this lengthy job for a while. This improves work efficiency.

The system control unit 700 is in charge of handling jobs for the scanner unit 100 and the operation/display unit 200. When jobs are thrown in parallel, the system control unit 700 controls and manages these jobs in parallel.

In this fourth example, the operation/display unit 200 receives an electric power from the power supply unit 206 so as to be able to operate on its own. A job may be partly finished with respect to the scan part thereof, but a preceding job does not appear to come to an end soon, and the user of this preceding job may indicate upon consultation that this job cannot be suspended. In such a case, the operation/display unit 200 may be disconnected from the image forming apparatus, and may be carried around. The image forming apparatus may be provided with a unit substantially the same as the information transmitting unit 203, and may use this unit to inform the disconnected operation/display unit 200 that the preceding job has come to an end. Upon being informed, the user may use the function of the information transmitting unit 203 to send a job from the RAM 205 to the image forming apparatus from which the operation/display unit 200 is disconnected, thereby performing printing. Even if the preceding job is not yet finished, the operation/display unit 200 may be mounted on another image forming apparatus having the same configuration as the above-noted image forming apparatus, thereby performing printing. When the job comes to an end, the flowchart shown in FIG. 14 is performed.

With the provision as described above, the use of the information transmitting unit 203 makes it possible to communicate with an image forming apparatus that is ready to perform printing, thereby making use of an available image forming apparatus. This can avoid an undesirable suspension of work.

In this fourth example, the ID input/identify/display unit 202 may be used to enter a hard key inclusive of ID information such as a name, and such hard key may be used for identification purposes. This eliminates a need for manual inputting. Here, "ID information" refers to a user named and an ID code (one type of a password) The hard key needed by the information transmitting unit 203 is retrieved from the ROM 204. The ROM 704 of the image forming apparatus may store therein an ID code and/or user name for permitting the use of the image forming apparatus, thereby restricting use by users not listed in this information. Entry of information into the ROM 704 is done manually, and can be performed only by an administrator as a special operational procedure needs to be followed.

As described above, the ID information is implemented as a dedicated hard key, which eliminates a need for a user to enter the ID information by use of the operation/display unit 200. This improves work efficiency.

In the fourth example, the ID input/identify/display unit 202 may be provided with the function to identify a fingerprint. In contrast with the case in which a hard key is used, there is no possibility of loss or theft.

In the fourth example, the ROM 204 may be provided with an additional program that compares the sizes of two or more jobs with each other. The sizes of jobs may be identified as a small quantity or not. What this small quantity is may be defined by use of the operation/display unit 200 in advance by specifying the number of copy sheets that is considered to be small. Information indicative of this small quantity may be stored in the RAM 705. The system control unit 700 retrieves this information from the RAM 705. If the job is found to be small, an ongoing print job with a large quantity is temporarily stored in the RAM 205 of the operation/display unit 200, thereby allowing this small quantity job to perform printing. The stored job is then retrieved from the RAM 205, and continues its printing operation.

With the provision as described above, there is no need to go to the length of asking about the ongoing print job as previously described, thereby improving work efficiency.

In the fourth example, priority may be assigned in advance to ID information, so that a priority order may be set to jobs. The system control unit 700 determines a high priority print job so as to allow the high priority job to perform printing first.

With the provision as described above, the ID input/identify/display unit 202 can identify the priority of ID information, thereby performing printing operations in the order of priority. This improves work efficiency.

In the following, a description will be given of a copy machine according to a fifth example of the present embodiment. This copy machine utilizes the power supply control units 500(1), 500(2), and so on that control the supply of power to the detachable scanner unit 100 and imaging unit 300.

Figure 15A:
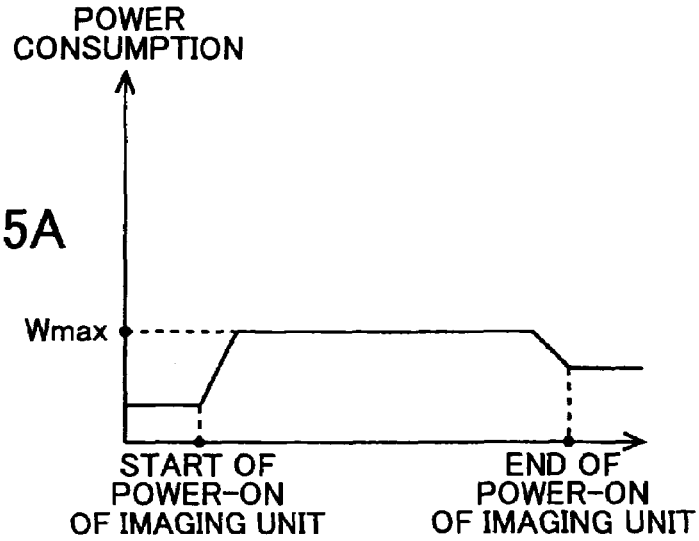
FIGS. 15A through 15C are graph charts showing power consumption at the time of power-on of imaging units.
Figure 15B:
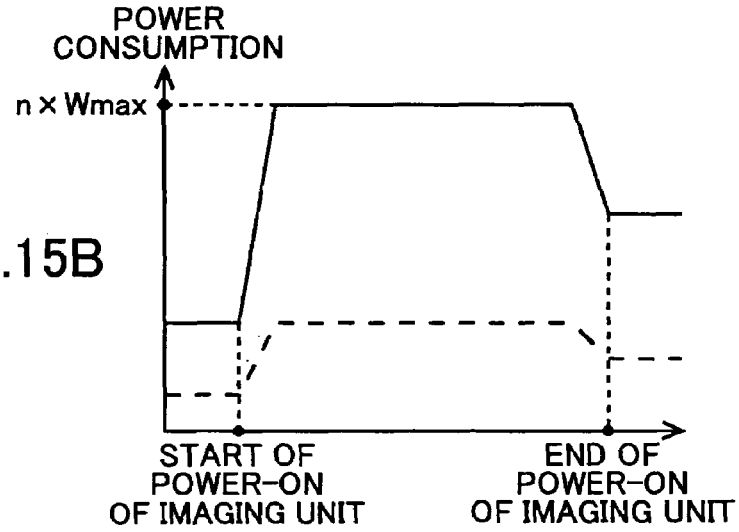

Conventionally, an energy-conservation mode that achieves energy saving by controlling the power supply of the imaging unit is known as a technology for achieving energy saving in the image forming apparatus. As is disclosed in Japanese Patent Application Publication No. 2001-22234, the imaging unit 300 requires a large amount of electric power at the time of power-on (see FIG. 15A). In an image forming apparatus in which a plurality of imaging units 300(1), 300(2), and so on are provided as in this embodiment, simultaneous activation of all the imaging units requires as much electric power as there are imaging units, and also requires the power supply unit that can supply such electric power (see FIG. 15B). Instead of activating all the imaging units at once, the imaging units may be activated one by one with some time intervals therebetween. This can reduce power consumption at the time of activating the imaging units (see FIG. 15C). The fifth example avoids the simultaneous recovery of the components that constitute the copy machine from the energy-saving mode so as to suppress excess power consumption, and adjusts the operating state of the copy machine to improve work efficiency.

Figure 16:
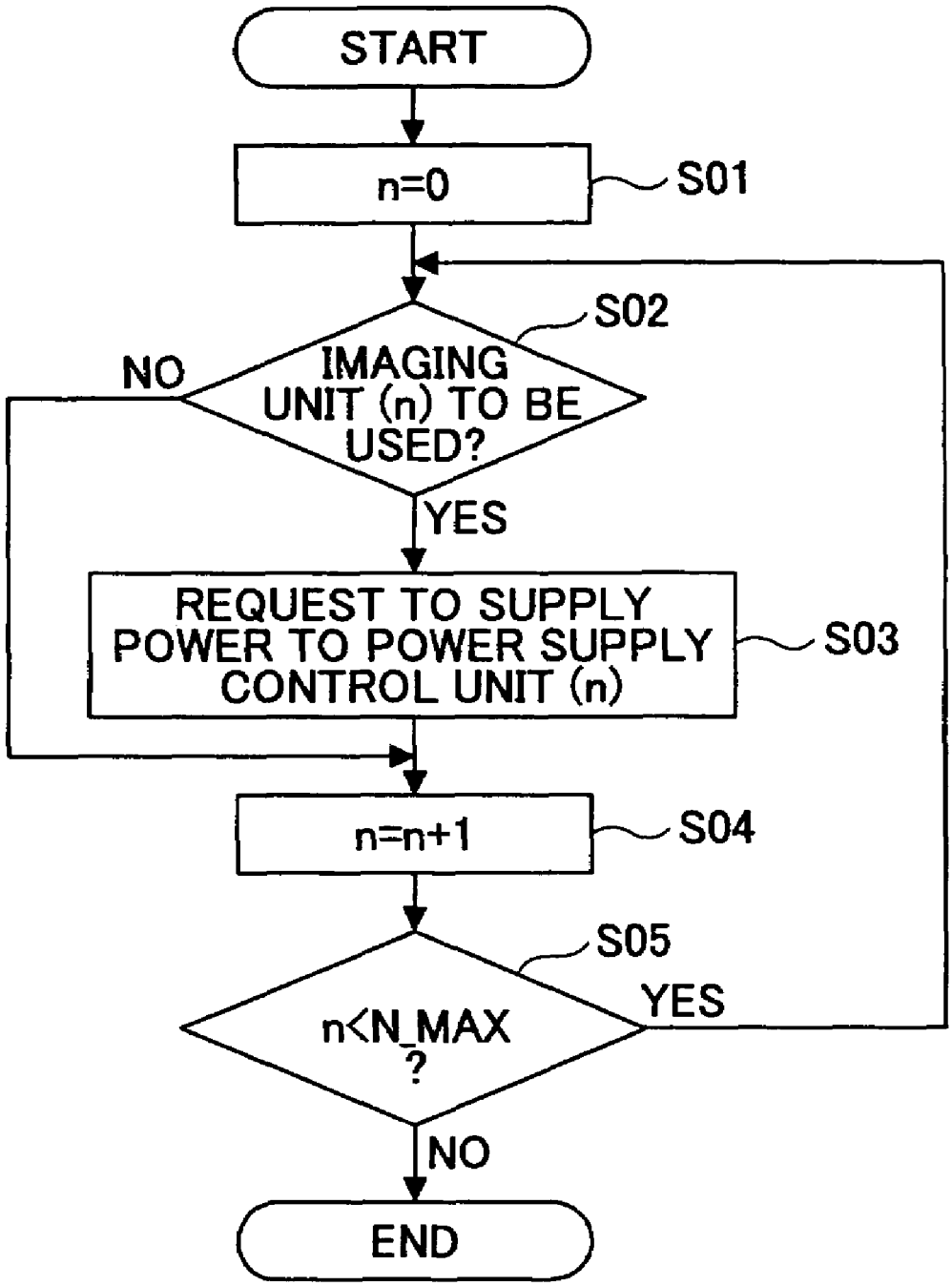

In the following, a description will be given of an operation performed when a power is supplied to predetermined components. FIG. 16 is a flowchart of an operation performed by the system control unit 700 when the power of a plurality of detachable imaging units 300 is switched on.

When the image forming apparatus is not in use, none of the imaging units 300 is operating (S01). When the power is switched on, or when a job is created in the copy machine so that the use of an imaging unit 300 becomes necessary for printing operation (Yes at S02), the power supply control unit 500 that corresponds to the needed imaging unit is requested to power on (S03). The same procedure is performed with respect to other imaging units 300 (S04). When all the necessary imaging units 300 are requested to power on, the procedure comes to an end (No at S05).

When the power is to be switched off, in the same manner as described above, the power supply control units 500 that correspond to the imaging units 300 ready to power off (i.e., in the state of being ready to power off since there is no ongoing operation such as a printing operation) are requested to power off. FIG. 17 is a table showing an example of the relationships between the components that constitute the image forming apparatus such as the imaging units 300(1), 300(2), and so on and the power supply control units 500(1), 500(2), and so on that correspond to these components.

Figure 18:
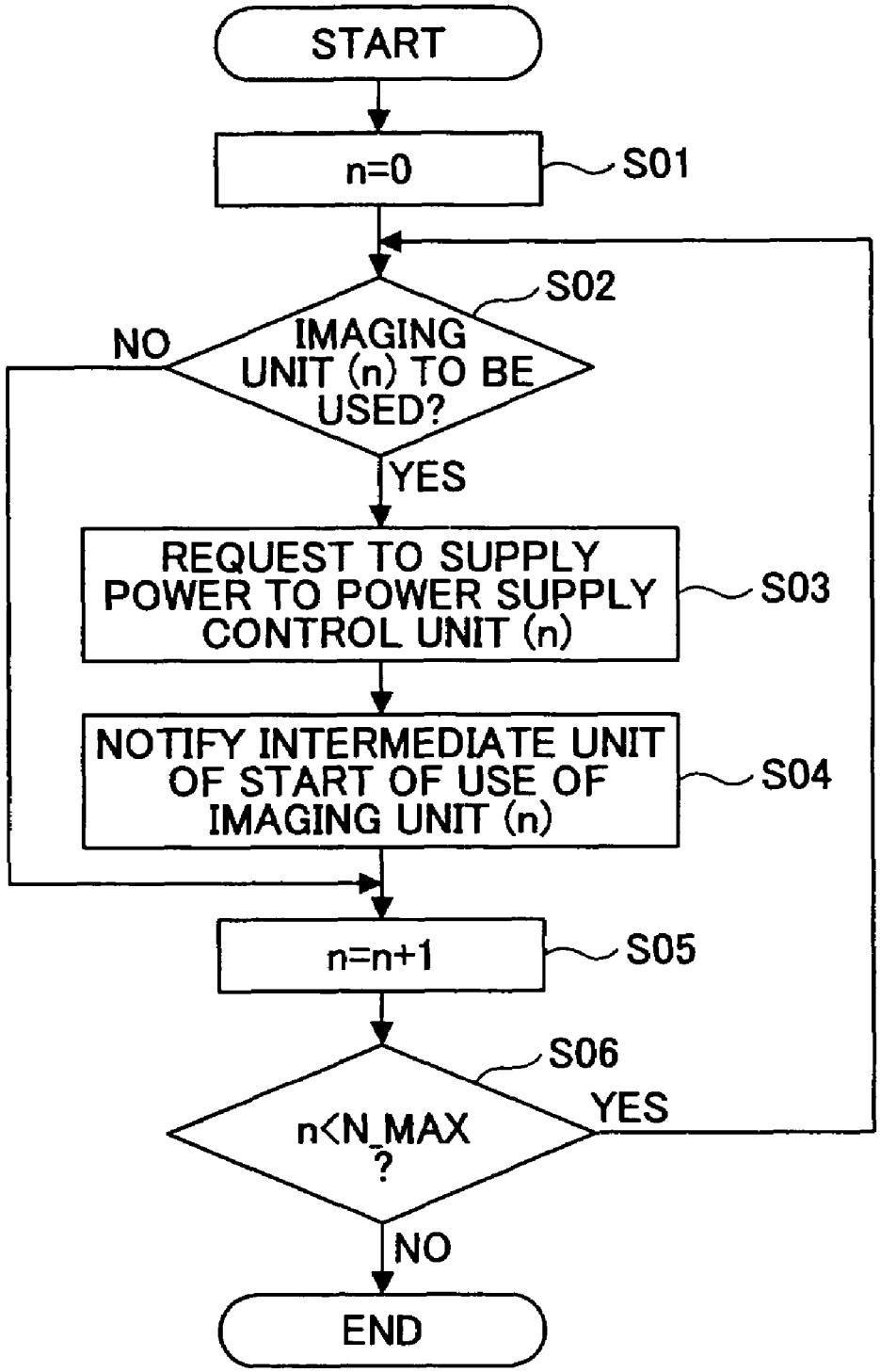
FIG. 18 is a flowchart of an operation performed by the system control unit.
Figure 19:
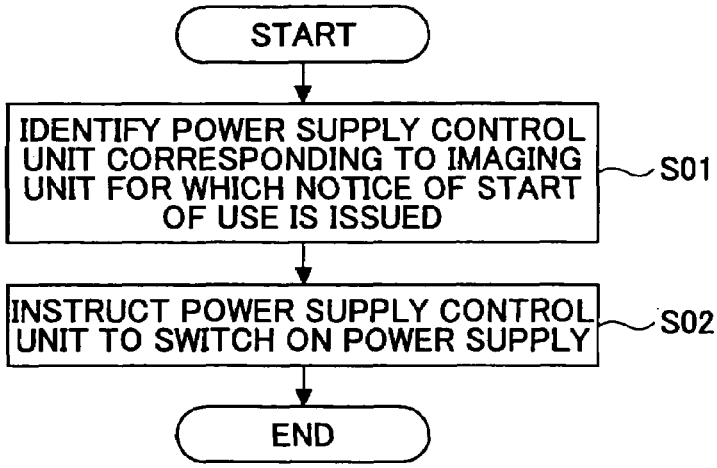
FIG. 19 is a flowchart of an operation performed by an intermediate unit.

Instead of using the system control unit 700 to control the power supply of the power supply control units 500(1), 500(2), and so on, the intermediate unit 5001 may be used. FIG. 4 should be consulted for the configuration in this case. In FIG. 4, the intermediate unit 5001 knows which power supply control units 500(1), 500(2), and so on correspond to which imaging units 300 and scanner units 100. Upon being informed by the system control unit 700 of certain information such as the usage of the scanner units 100 and the imaging units 300, the intermediate unit 5001 controls each of the power supply control units 500. FIG. 18 is a flowchart of an operation performed by the system control unit 700. FIG. 19 is a flowchart of an operation performed by the intermediate unit 5001.

The flowchart of FIG. 18 differs from the flowchart of FIG. 16 in that step S04 is provided. After the system control unit 700 requests a power supply control unit to supply an electric power (S03), the system control unit 700 notifies the intermediate unit 5001 of the start of use of the corresponding imaging unit 300 (S04). The following steps are the same. In the flowchart of FIG. 19, the intermediate unit 5001 having received the notice identifies the corresponding power supply control unit 500 (S01), and instructs to switch on the power supply (S02).

By use of the table as shown in FIG. 17, the intermediate unit 5001 can find which power supply control units 500(1), 500(2), and so on correspond to which imaging units 300 and scanner units 100. Since the system control unit 700 does not have to attend to these correspondences, flexible power supply control can be achieved.

Figure 20:
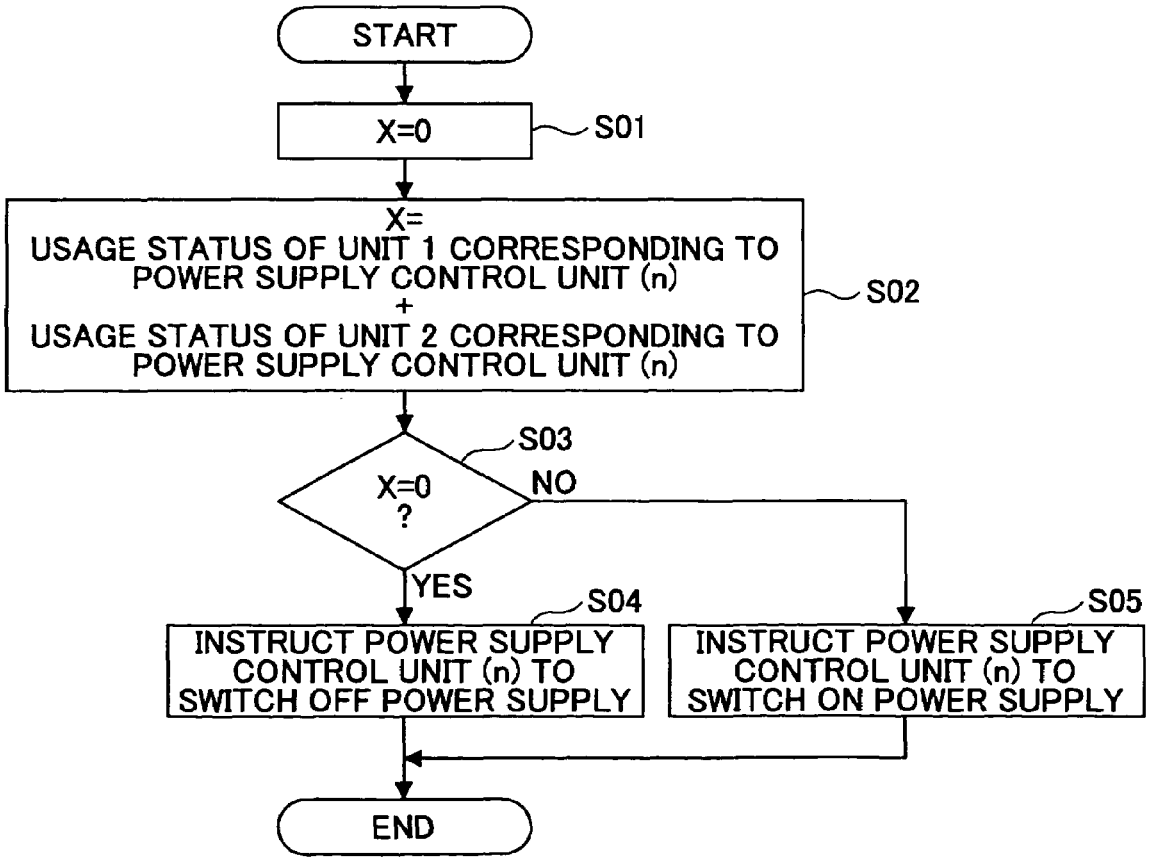
FIG. 20 is a flowchart of an operation performed when a single power supply control unit controls the power supplies of a plurality of imaging units and scanner units.

FIG. 20 is a flowchart of an operation performed when a single power supply control unit 500 controls the power supplies of, a plurality of imaging units 300 and scanner units 100. When a single power supply control unit corresponds to a plurality of units as shown in the table of FIG. 21A, the intermediate unit 5001 stores data indicative of the usage status of the scanner units 100 and the imaging units 300 as it is informed from the system control unit 700 (S01, S02) as shown in FIG. 21B. If none of the corresponding power supply control units is being used (Yes at S03), the power is switched off (S04). If any one of them is being used (No at S03), the power is switched on (S05).

Figure 15C:
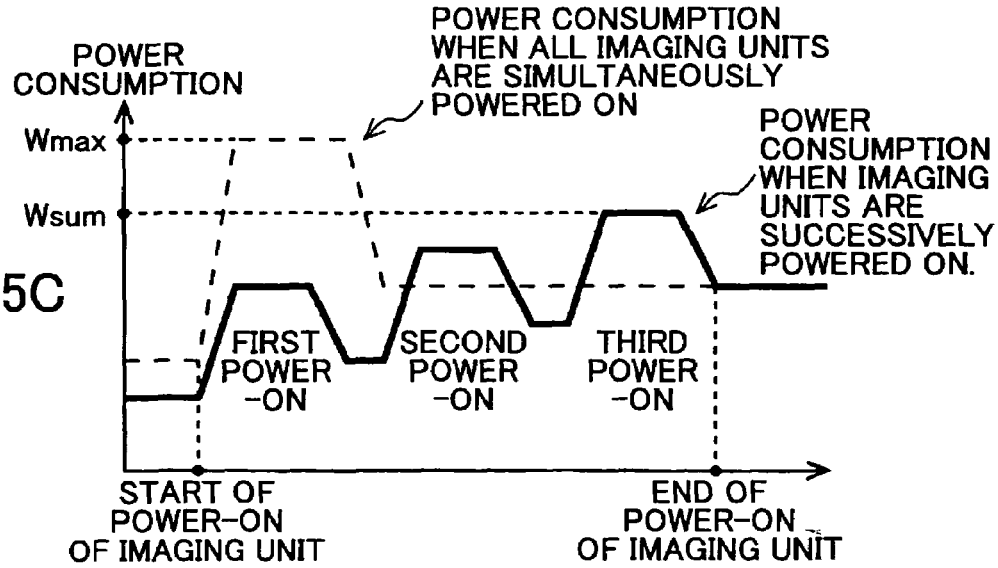
Figure 22:
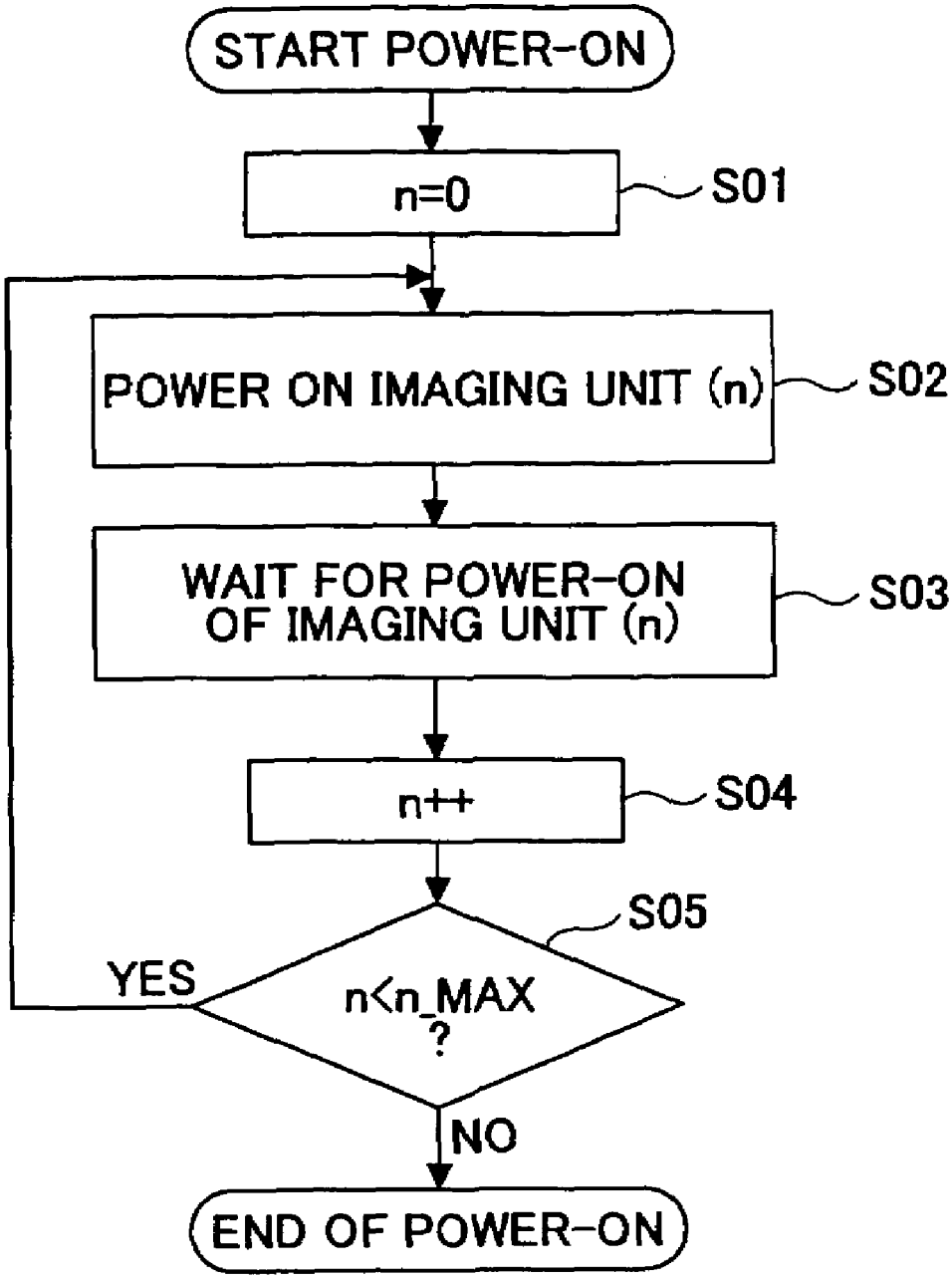
FIG. 22 is a flowchart of an operation that activates the imaging units one after another.

In the following, a description will be given of a method of controlling power supply according to the fifth example. In this method, the imaging units are activated one after another with time intervals therebetween as shown in FIG. 15C. FIG. 22 is a flowchart of an operation that activates the imaging units 300 one after another.

At the beginning, every one of the imaging units 300 is in the powered-off state (S01). An imaging unit 300 is then powered on (S02), and the completion of the power-on of this imaging unit 300 is waited for (S03). These steps are performed with respect to each of the imaging units 300 (S04). If all the imaging units 300 are powered on, the procedure comes to an end (S05). This procedure is the same with respect to the scanner units 100 or the like. With this provision, power consumption at the time of power-on can be reduced.

Figure 23:
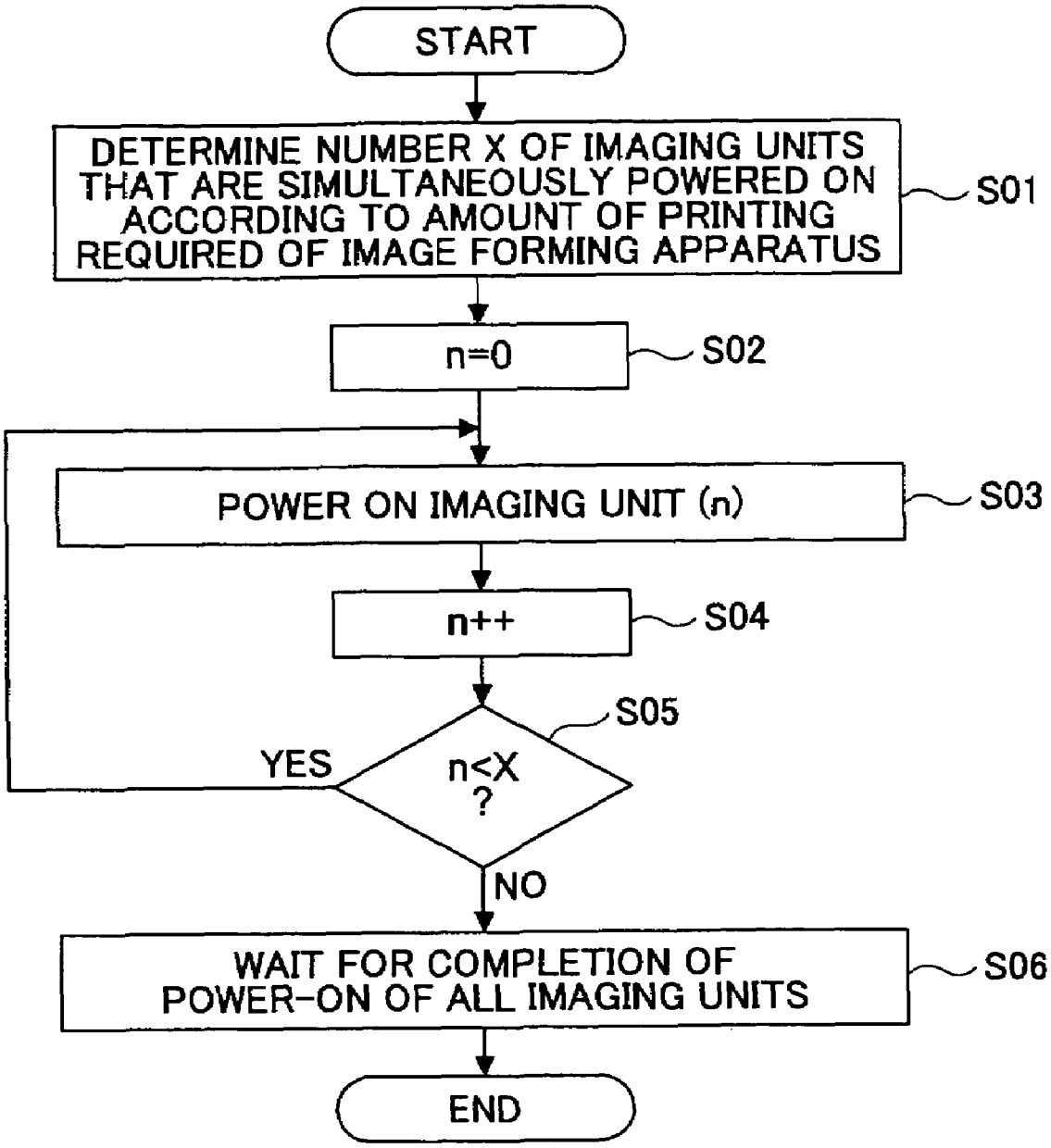
FIG. 23 is a flowchart of an operation that activates simultaneously some but not all of the imaging units.
Figure 24:
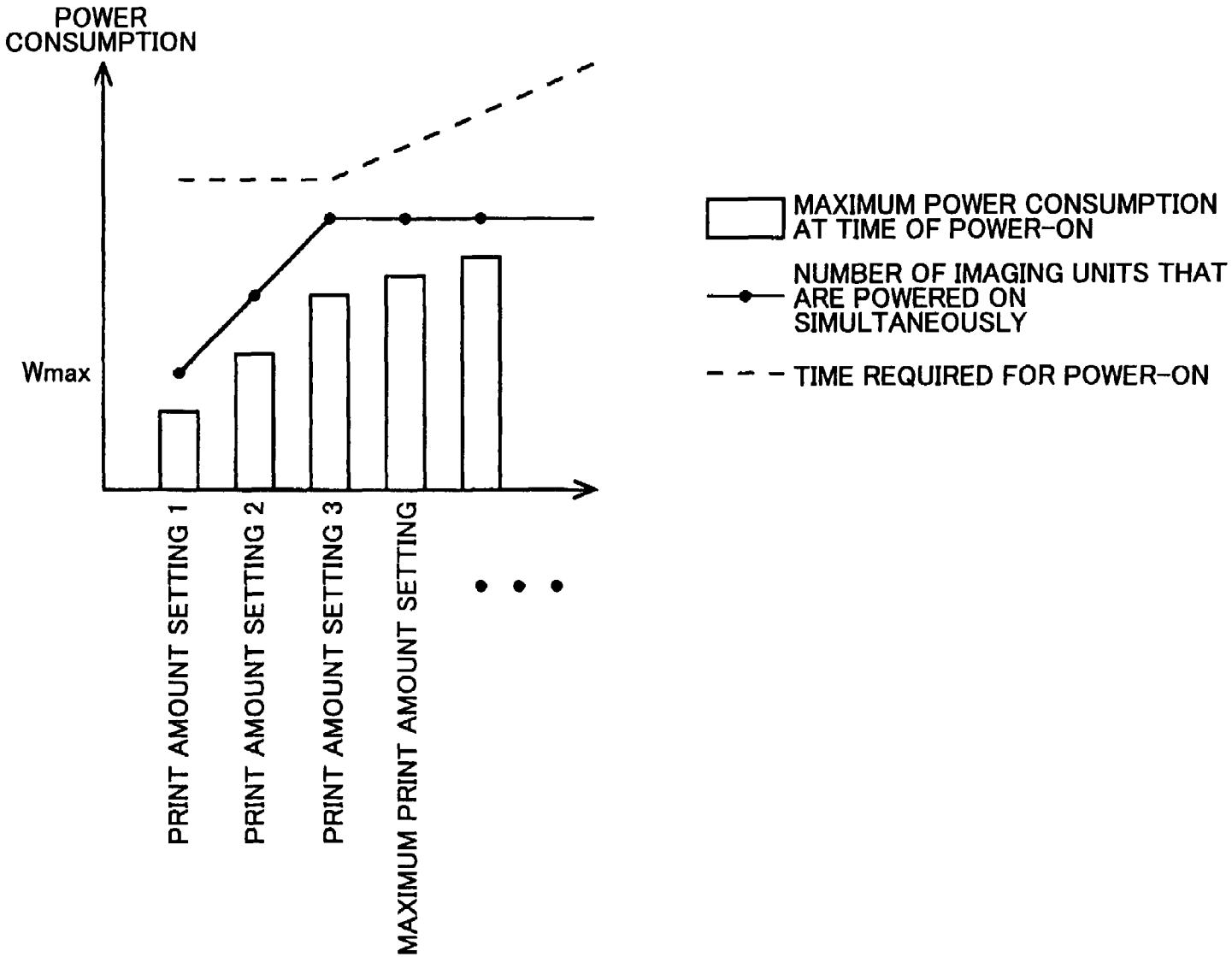
FIG. 24 is a graph chart showing the relationships between the amount of printing, the maximum power consumption at the time of power-on of imaging units, and the time required to activate the image forming units.

When the imaging units 300 are successively activated as shown in FIG. 15C, the time required for all the imaging units 300 to power on increases in proportion to the number of the imaging units 300. In consideration of this, some but not all of the imaging units 300 may be simultaneously powered on, thereby shortening the activation time while reducing power consumption. FIG. 23 is a flowchart of an operation that activates simultaneously some but not all of the imaging units. In this method, relationships between the amount of printing, the maximum power consumption at the time of power-on of the imaging units 300, and the time required to activate the image forming units are represented as shown in FIG. 24.

First, a user enters a predetermined input indicating the amount of printouts by use of the operation/display unit 200, thereby determining the number "X" of the imaging units 300 that are simultaneously activated in response to the amount of printouts requested of the image forming apparatus (S01). The imaging units 300 are then activated as many as indicated by the determined number (S02 through S04). When X units are activated (No at S05), the completion of activation of all the imaging units 300 is waited for (S06). In this manner, the number of the imaging units 300 that are simultaneously activated (powered on) is adjusted according to the amount of printouts required of the imaging units 300. This can further shorten the time required for activation while reducing costs as in the previous example. If the amount of printouts exceeds a predetermined amount, the operation shown in the flowchart of FIG. 23 may be performed piece by piece, thereby ensuring that an electric power exceeding a predetermined amount (i.e., the electric power consumed at the time of simultaneous activation of all the imaging units 300) is not consumed.

FIG. 25 is a table showing the relationships between the amount of printouts and the number of the imaging units 300 that are simultaneously activated. As an indication of the amount of printouts, the number of printed copies, the number of printed pages, the number of printed sheets may be used. Further, the requirement of the amount of printouts may be changed by a user to a desired amount, which is stored in the RAM 703. This makes it possible to perform a recovery operation from the energy-saving mode in a manner suitable to the environments in which the user uses the apparatus. By the same token, the number of simultaneously activated units may be modified by a user as he/she wishes, and may be stored in the RAM 703 to achieve the same results. In this manner, both the amount of printouts and the number of simultaneously activated units may be made settable and recordable, thereby further improving convenience.

Further, the present invention is not limited to these embodiments, but various variations and modifications may be made without departing from the scope of the present invention.

The present application is based on Japanese priority application No. 2004-374721 filed on Dec. 24, 2004, with the Japanese Patent Office, the entire contents of which are hereby incorporated by reference.

What is claimed is:

1. An image forming apparatus, comprising:

two or more detachable components that are identical to each other and configured to perform at least part of a sequence of processes associated with electrophotographically forming of an image;

a connection detection unit configured to detect attaching of said components;

a first control unit configured to control the sequence of processes; and an intermediate unit configured to control a software based controller for controlling one of said components by mediating a process performed between said first control unit and said software based controller, wherein the software-based controller is generated in response to said connection detection unit detecting attaching of said one of said components.

2. The image forming apparatus as claimed in claim 1, wherein said one of said components is a scanner unit configured to illuminate a document and to produce image data based on light reflected from the illuminated document, and said software based controller is a scanner unit controller configured to control said scanner unit, and wherein said intermediate unit includes a second memory unit for storing information about said scanner unit.

3. The image forming apparatus as claimed in claim 2, further comprising a second memory unit for storing information about said scanner unit, wherein said intermediate unit is configured to read the information about said scanner unit stored in said second memory unit.

4. The image forming apparatus as claimed in claim 1, wherein one of said components is an operation/display unit configured to receive a predetermined input and to display a predetermined content, and another one of said components is a scanner unit configured to illuminate a document and to produce image data based on light reflected from the illuminated document, and wherein said first controller sets a correspondence between said operation/display unit and said scanner unit that operates in response to an input from said operation/display unit.

5. The image forming apparatus as claimed in claim 4, wherein said operation/display unit includes a memory unit for storing information to be processed by said operation/display unit.

6. The image forming apparatus as claimed in claim 4, wherein said operation/display unit includes a second control unit configured to control a sequence of processes performed by said operation/display unit.

7. The image forming apparatus as claimed in claim 4, further comprising an identification unit configured to identify a user based on identification information that uniquely identifies users who use said operation/display unit.

8. The image forming apparatus as claimed in claim 7, wherein said operation/display unit includes an information exchange unit configured to exchange predetermined information with another part of said image forming apparatus.

9. The image forming apparatus as claimed in claim 7, wherein the identification information is a dedicated hard key.

10. The image forming apparatus as claimed in claim 7, wherein the identification information is a user fingerprint.

11. The image forming apparatus as claimed in claim 7, wherein said operation/display unit includes a comparison unit configured to compare sizes of jobs relating to the sequence of processes, and wherein a job having small size identified by said comparison unit is performed ahead of other jobs.

12. The image forming apparatus as claimed in claim 7, wherein the identification information includes information indicative of priority of jobs relating to the sequence of processes, and wherein a job having higher priority is performed ahead of other jobs.

13. An image forming apparatus, comprising:

two or more detachable components that are identical to each other and configured to perform at least part of a sequence of processes associated with forming of an image;

a connection detection unit configured to detect attaching of said components; and a first control unit configured to control the sequence of processes, wherein a software-based controller for controlling one of said components is generated in response to said connection detection unit detecting attaching of said one of said components, and wherein said one of said components is a scanner unit configured to illuminate a document and to produce image data based on light reflected from the illuminated document, and said software based controller is a scanner unit controller configured to control said scanner unit, and wherein said first control unit includes a memory unit for storing information about said scanner unit.

14. An image forming apparatus, comprising:

two or more detachable components that are identical to each other and configured to perform at least part of a sequence of processes associated with forming of an image;

a connection detection unit configured to detect attaching of said components; and a first control unit configured to control the sequence of processes, wherein a software-based controller for controlling one of said components is generated in response to said connection detection unit detecting attaching of said one of said components, and wherein said one of said components is a scanner unit configured to illuminate a document and to produce image data based on light reflected from the illuminated document, and said software based controller is a scanner unit controller configured to control said scanner unit, said image forming apparatus further comprising a memory unit for storing information about said scanner unit, wherein the information about said scanner unit relates to a scan color setting that specifies a color system used in scanning of the document.

15. The image forming apparatus as claimed in claim 14, wherein said first control unit is configured to select a scanner unit corresponding to the scan color setting.

16. The image forming apparatus as claimed in claim 15, further comprising a notification unit configured to notify a user of the scanner unit selected by said first control unit.

17. The image forming apparatus as claimed in claim 15, further comprising an auto document feeder unit configured to supply the document to the scanner unit selected by said first control unit.

18. An image forming apparatus, comprising:

two or more detachable components that are identical to each other and configured to perform at least part of a sequence of processes associated with electrophotographically forming of an image;

a connection detection unit configured to detect attaching of said components;

a first control unit configured to control the sequence of processes; and a power supply control unit configured to control power supply to said components, wherein said power supply control unit is configured to change timing of the power supply independently for each of said components, wherein a software-based controller for controlling one of said components is generated in response to said connection detection unit detecting attaching of said one of said components.

19. The image forming apparatus as claimed in claim 18, wherein said power supply control unit determines a number of the components to which a power is supplied in accordance with an amount of printing required of said image forming apparatus.

20. The image forming apparatus as claimed in claim 19, wherein one of said components is an operation/display unit configured to receive a predetermined input and to display a predetermined content, and wherein said power supply control unit is configured to determine, in response to a predetermined input received by said operation/display unit, a number of the components to which a power is simultaneously supplied.

21. The image forming apparatus as claimed in claim 19, wherein one of said components is an operation/display unit configured to receive a predetermined input and to display a predetermined content, and wherein said power supply control unit is configured to determine the amount of printing in response to a predetermined input received by said operation/display unit.

* * * * *